US007155148B2

(12) United States Patent
Nishimura et al.

(10) Patent No.: US 7,155,148 B2
(45) Date of Patent: Dec. 26, 2006

(54) IMAGE FORMING APPARATUS

(75) Inventors: Shigeki Nishimura, Saitama (JP); Hiromitsu Koizumi, Saitama (JP); Norio Irie, Saitama (JP); Masayuki Nishimura, Saitama (JP); Takuji Matsumoto, Saitama (JP); Naomasa Okimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 226 days.

(21) Appl. No.: 10/872,542

(22) Filed: Jun. 22, 2004

(65) Prior Publication Data

US 2005/0100354 A1 May 12, 2005

(30) Foreign Application Priority Data

Nov. 7, 2003 (JP) ..... P.2003-378987

(51) Int. Cl.
*G03G 15/08* (2006.01)
*G03G 21/18* (2006.01)

(52) U.S. Cl. ..... 399/257; 399/111; 399/112

(58) Field of Classification Search ..... 399/257, 399/120, 119, 111, 113, 112
See application file for complete search history.

(56) References Cited

U.S. PATENT DOCUMENTS 4,757,344 A * 7/1988 Idenawa et al. ..... 399/113
4,845,523 A * 7/1989 Miyaji ..... 399/113
5,752,137 A * 5/1998 Haneda ..... 399/113
6,072,967 A * 6/2000 Sugihara et al. ..... 399/113
6,549,737 B1 * 4/2003 Sano et al. ..... 399/111

FOREIGN PATENT DOCUMENTS

| | | |
|---|---|---|
| JP | 9-325662 | 12/1997 |
| JP | 09-325670 | 12/1997 |
| JP | 10-153933 | 6/1998 |
| JP | 11-084968 | 3/1999 |
| JP | 2912073 B2 | 4/1999 |
| JP | 2001-117440 | 4/2001 |

* cited by examiner

*Primary Examiner*—Susan Lee
(74) *Attorney, Agent, or Firm*—Morgan, Lewis & Bockius LLP

(57) ABSTRACT

An image forming apparatus for forming an image with a developing agent, includes: a collecting-developing-agent occurring part in which the collecting developing agent to be collected in the developing agent occurs; a collection container for accommodating the collecting developing agent; a transporting part provided so as to connect the collection container and the collecting-developing-agent occurring part and for collecting and transporting the collecting developing agent occurring in the collecting-developing-agent occurring part; and a replacement part removably mounted in an apparatus body, wherein the collection container is mounted to be integrated with the replacement part.

17 Claims, 16 Drawing Sheets

IMAGE FORMING APPARATUS

BACKGROUND OF THE INVENTION

1. Field of the Invention

The present invention relates to an image forming apparatus such as a printer, a copying machine, a facsimile machine, or the like for forming an image constituted by a developing agent or agents and a combination machine combining these respective functions. More particularly, the invention concerns an image forming apparatus capable of improving convenience at the time of maintenance or various handling of such as a collection container accommodating a collecting developing agent which is to be collected among the developing agents used in the image formation.

2. Description of the Related Art

In an image forming apparatus for forming an image constituted by a developing agent or agents by adopting the electrophotographic process or the like, basic image formation is mainly effected in the following manner, and part of the developing agent used in the image formation is disused and is collected.

Namely, after an electrostatic latent image corresponding to predetermined image information is formed on an image carrier such as a photoconductor drum, the electrostatic latent image is developed by a developing agent such as a two-component developing agent, thereby forming a developing agent image (actually, a toner image constituted by a toner component). Subsequently, that developing agent image is transferred onto predetermined recording paper directly or indirectly through an intermediate transfer unit such as an intermediate transfer belt, and is then subjected to fixation. Image formation is thereby effected. In a case where not a monochrome image (mainly black image) but a color image which is formed by superposing monochrome developing agent images of a plurality of colors is formed as the image, the above-described development process and the development-agent-image transfer process are similarly repeated by the number of the monochrome development agent images required for forming that color image.

At the time of this image formation, an untransferred developing agent (mainly a toner component) or the like, which fails to be properly transferred onto a transfer destination, occurs at the time of transfer of the developing agent image, such as during primary transfer from the image carrier to the recording paper or the intermediate transfer unit, or during secondary transfer from the intermediate transfer unit to the recording paper. After such an untransferred developing agent is removed from the image carrier, the intermediate transfer unit, or the like by a cleaning device, the untransferred developing agent is collected in a collection container. In addition, in the case where the above-described color image is formed as the image, a plurality of image carriers such as the aforementioned photoconductor drums, and developing agent image of predetermined colors are respectively formed on the image carriers and are transferred onto the recording paper. Alternatively, an intermediate transfer system is frequently adopted in which a plurality of monochrome developing agent images formed on a single or a plurality of image carriers are superposed on the intermediate transfer unit, and these monochrome developing agent images are then collectively transferred onto the recording paper. However, in such a case, portions of occurrence of the collecting developing agents to be collected increase. Incidentally, in this case where the portions of occurrence of the collecting developing agents increase, it is generally necessary to cope with the case by increasing the number of transporting parts for transporting the collecting developing agents from the portions of occurrence of the collecting developing agents to the accommodating container, or by increasing the number of collection containers for accommodating the collecting developing agents.

In the image forming apparatus in which such a collecting developing agent is collected in a collection container, it is necessary to perform maintenance operation in which when the collecting developing agent to be collected in the collection container has become full, such a collection container is removed from an apparatus body and is then replaced with a new collection container, and the new collection container is mounted in the apparatus body.

However, in a case where a plurality of such collection containers are installed at a plurality of portions within the apparatus body, the replacement operation of those collection containers is required by the number of the collection containers, so that the maintenance operation becomes troublesome.

In a case where, for example, a so-called trickle development system is adopted as the development system, such a troublesome aspect is exacerbated since the number of parts of occurrence of the collecting developing agents further increases as developing devices adopting that development system correspond to the portions (parts) where the collecting developing agents occur. The trickle development system is a development system whereby, as a development system using a two-component developing agent whose principal components are toner and carrier, the two-component developing agent is replenished to the developing device slightly excessively, and a rather old developing agent stagnating in that developing device is mainly caused to overflow to outside the device as an excess developing agent and is collected. This ensures that the developing device is kept in a state of accommodating as much new developing agent as possible, so as to stabilize the development performance.

In contrast, as image forming apparatuses having a plurality of portions where the collecting developing agents occur such as cleaning devices, image forming apparatuses have conventionally been proposed which are constructed such that waste toner (collecting developing agent) collected by a plurality of cleaning devices is adapted to be collectively accommodated in a single collection container, for the purpose of simplifying the maintenance operation of the collection container for collecting that collecting developing agent and its mounting operation (e.g., refer to JP-A-9-325662, JP-A-10-153933 and JP-B-2912073). JP-A-9-325662 also discloses a technique of adopting a structure in which the single collection container is directly engaged with waste toner discharge portions of a plurality of cleaning devices.

JP-A-9-325662 (claim 6, paragraphs [0007] and [0043], FIG. 1, FIG. 4), JP-A-10-153933 (claim 1, paragraphs [0014] and [0035], FIG. 1) and JP-B-2912073 (paragraphs [0006] and [0039], FIG. 1) are referred to as related arts.

However, the following problems are encountered with the above-described image forming apparatus in which the collecting developing agents occurring from the plurality of parts of occurrence of the collecting developing agents are collectively accommodated in the single collection container.

Namely, in such an image forming apparatus, in a case where replacement parts requiring replacement at predetermined timings in view of useful life or the like (e.g., image carriers, an intermediate transfer unit, and developing devices) are removably mounted in the apparatus body, it has been necessary to separately perform the operation of replacing the aforementioned collection container in addition to the operation of replacing those replacement parts. For this reason, troublesome operation is inconveniently imposed on the user of such an image forming apparatus at the time of maintenance and handling of that collection container and the like.

In addition, since the collection container collectively accommodates the collecting developing agents from the plurality of parts of occurrence of the collecting developing agents, its capacity is required to a certain extent, so that the collection container tends to become large in size. From the viewpoint of making it possible to facilitate the mounting/removing replacement of such a large-size collection container, the collection container is frequently installed on an accessible one side surface side of the apparatus body. In this case, the apparatus body can also become large-sized by the portion in which its installation space is secured. This fact becomes a disadvantageous factor in rendering the image forming apparatus compact. In addition, in the event that a collection container having a small capacity is used, the collection container is filled up in a relatively short time cycle, and its replacement frequency becomes large, so that there is a possibility of frequently repeating the above-described troublesome maintenance operation.

SUMMARY OF THE INVENTION

The invention provides an image forming apparatus which has replacement parts removably mounted in the apparatus body in addition to the collection container for the collecting developing agents, and which is capable of enhancing convenience at the time of such as the maintenance of that collection container without resulting in such as the enlarged size of the apparatus.

The image forming apparatus for forming an image with a developing agent, has: a collecting-developing-agent occurring part in which a collecting developing agent to be collected in the developing agent occurs; a collection container for accommodating the collecting developing agent; a transporting part to connect the collection container and the collecting-developing-agent occurring part and for collecting and transporting the collecting developing agent occurring in the collecting-developing-agent occurring part; and a replacement part removably mounted in an apparatus body, wherein the collection container is mounted to be integrated with the replacement part.

BRIEF DESCRIPTION OF THE DRAWINGS

Preferred embodiment of the present invention will be described in detail based on the following figures, wherein:

FIG. 11 is an explanatory diagram illustrating the relationship between a developing device and the collection box and the like;

DETAILED DESCRIPTION OF THE PREFERRED EMBODIMENTS

Figure 1A:
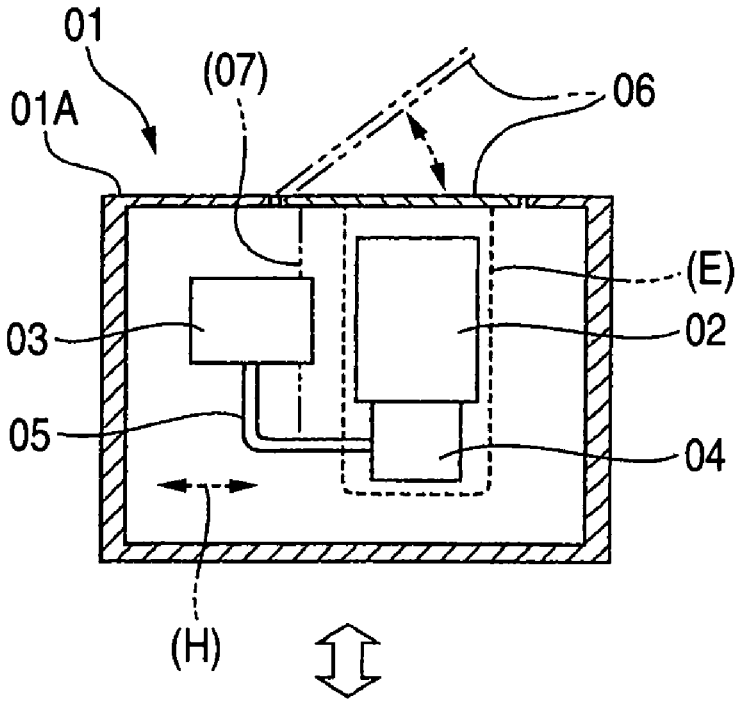
FIGS. 1A and 1B are conceptual diagrams illustrating an image forming apparatus in accordance with an embodiment (a state in which replacement parts and the like are mounted or removed.
Figure 1B:
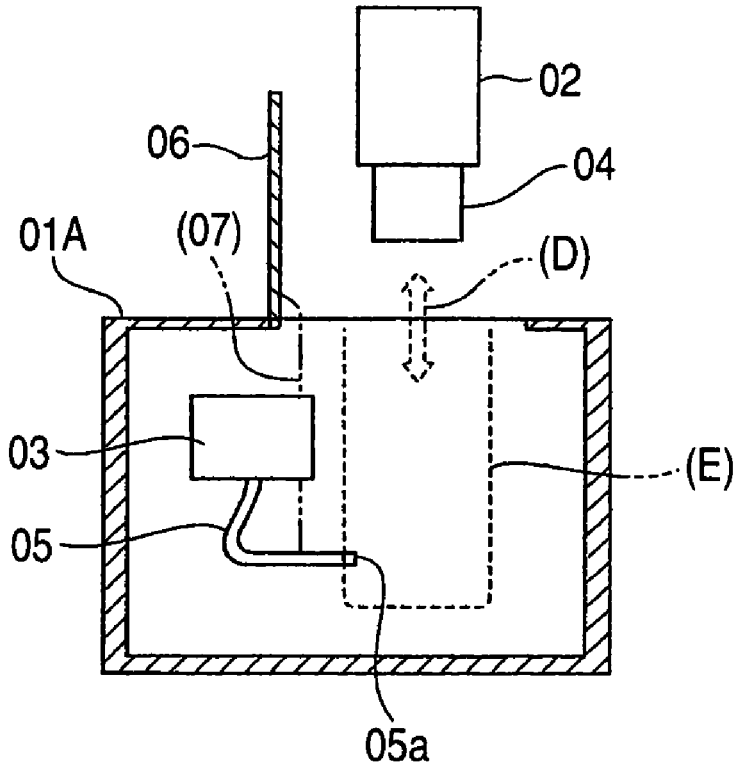

As illustrated in FIGS. 1A and 1B, the image forming apparatus in accordance with an embodiment is an apparatus 01, which forms an image with a developing agent, has: a collecting-developing-agent occurring part 03 in which the collecting developing agent to be collected in the developing agent occurs; a collection container 04 for accommodating the collecting developing agent; a transporting part 05 to connect the collection container 04 and the collecting-developing-agent occurring part 03 and for collecting and transporting the collecting developing agent occurring in the collecting-developing-agent occurring part 03; and a replacement part 02 removably mounted in an apparatus body 01A, wherein the collection container 04 is mounted to be integrated with the replacement part 02.

Here, the aforementioned developing agent is mainly a colored fine powder used for developing an electrostatic latent image, and is specifically a mono-component developing agent having toner as a principal component, a two-component developing agent having toner and carrier as principal components, and so on. As the collecting developing agent to be collected in this developing agent, it is possible to cite, for example, a disused one such as the untransferred developing agent or one which is collected by the trickle development system, as referred to above.

As the collecting-developing-agent occurring part 03, any part is applicable insofar as it is a part in which a collecting developing agent to be collected in the collection container 04 occurs. For instance, it is possible to cite a cleaning device for removing and collecting the developing agent, a developing device adopting the trickle development system (in other words, the collecting developing agent occurs), and the like. This collecting-developing-agent occurring part 03 may be one which is removably mounted in the apparatus body 01A for the purpose of replacement operation. However, it is preferred that the collecting-developing-agent occurring part 03 be, as a rule, mounted in the apparatus body 01A in a remaining state (removable only in special cases such as maintenance and inspection). In the case where the collecting-developing-agent occurring part 03 is mounted as in the latter case, the collection container 04 requiring replacement operation is inevitably formed separately from such a collecting-developing-agent occurring part 03. Therefore, since it is necessary to improve convenience at the time of such as the maintenance of the collection container 04, the advantage derived from the invention is large.

The collection container 04 mounted on the replacement part 02 is not particularly limited insofar as the collection container 04 is capable of accommodating a predetermined amount of collecting developing agent. However, in terms of the number thereof, one piece is preferable. In a case where there are a plurality of collection containers 04, it is necessary for the replacement parts 02 which are subject to the mounting of the collection containers 04 thereon to be present in the same number. In addition, as for the size and shape of the collection container 04, the collection container 04 should preferably have such a size and shape that it does not project at least laterally (from an end in a perpendicular direction) as viewed in the moving direction at the time of the mounting or removing of the replacement part 02. This collection container 04 may be provided with a member capable of stirring or leveling the collecting developing agent which is accumulated and accommodated in the container, as necessary.

The transporting part 05 suffices if it is capable of collecting the collecting developing agent occurring in the collecting-developing-agent occurring part 03 and transporting it to the collection container 04. More specifically, it is possible to cite, for example, one which is constructed by a transporting passage member such as a transporting pipe for forming a passage for transporting the collecting developing agent as well as a collection-developing-agent feeding member such as an auger having the function of feeding the collecting developing agent inside that transporting passage member. This transporting part 05 is normally provided with a joint structure whereby a side 05*a* for joining that collection container 04 is capable of being spaced apart from the container 04 at the time of replacement of the collection container 04.

As the replacement part 02, a part is usable insofar as it is removably mounted in the apparatus body, and it is completely removed from the apparatus body upon arrival of its replacement period, and the whole of it (or a portion excluding the collection container) should be replaced with a new replacement part (in the case of a portion, a new part constituting that portion). The moving direction (D: see FIG. 1B) at the time of the mounting or removing of this replacement part 02 is, for instance, a direction toward an upper surface of the apparatus body 01A (a direction passing through a body upper surface portion), a lateral direction (a direction passing through a body side surface portion), and so on. As such a replacement part 02, it is possible to cite, for example, a replacement part having at least an image carrier constituted by such as a photoconductor, an intermediate transfer unit, or the like of a drum shape, a belt shape, or the like for carrying the image constituted by the developing agent. In addition, from the perspective of effectively obtaining the advantages derived from the invention, this replacement part 02 should preferably be not the collecting-developing-agent occurring part. In a case where a plurality of replacement parts 02 are present, it suffices if the collection container 04 is mounted on one of them.

In the invention, the collection container is mounted so as to be integrated with the replacement part 02. As for the mode of mounting the collection container 04, for instance, from the perspective of facilitating the final processing of the collecting developing agent accommodated in the collection container 04 and the reuse of the container, the collection container should preferably be removably mounted with respect to the replacement part 02. In a case where there are a plurality of replacement parts 02, it is also possible to prepare a plurality of collection containers 04, and the collection containers 04 may be distributed to all or some (excluding one) of the plurality of replacement parts 02, and may be mounted thereon, respectively.

In addition, the mounting position of the collection container 04 with respect to the replacement part 02 is not particularly restricted. However, the collection container 04 should preferably be disposed at a portion which is located on a forward side or a rearward side in the moving direction (D) of the replacement part 02 at the time of mounting or removing of the replacement part 02. In this case, the collection container 04 is also capable of moving integrally with the replacement part 02 in a moving space (E: see FIGS. 1A and 1B) required at the time of mounting or removing of the replacement part 02. Therefore, it is unnecessary to enlarge the moving space E by the position in which the collecting developing agent 04 is added, so that the apparatus is prevented from becoming large-sized. In this respect, in a case where the collection container 04 is mounted at a portion which is located on a lateral side of the moving direction of the replacement part 02, it is necessary to secure an extra space for the movement of the collection container 04, possibly resulting in the large size of the apparatus.

Furthermore, as for the mounting position of the collection container 04 with respect to the replacement part 02, the collection container 04 may be mounted at a portion of a lower side of the replacement part 02. Particularly in this case, in a case where the portion of the lower side of the replacement part 02 also corresponds to the aforementioned portion which is located on a forward side or a rearward side in the moving direction at the time of the mounting or removing of the replacement part 02, it is not particularly necessary to enlarge the moving space E of the replacement part 02, as described above. Therefore, this arrangement is more preferable. In addition, in a case where the portion of the lower side of the replacement part 02 corresponds to a position lower than a lowermost portion of the collecting-developing-agent occurring part 03, the collecting developing agent moves to the lower side. Therefore, the transport of the collecting developing agent by the transporting part 05 can be effected satisfactorily, so that this arrangement is preferable.

In addition, in the image forming apparatus in accordance with the invention, in a case where the image forming apparatus has a cover 06 to be opened or closed at the time of mounting or removing the replacement part 02 to which the collection container 04 is mounted, the transporting part 05 should preferably be mounted to be displaced between a position where the transporting part 05 joints to the collection container 04 and a position where the transporting part 05 is apart from the collection container 02, with opening/closing operation of a cover 06. In this case, as the cover 06 is opened or closed, the movement of the transporting part 05 toward or away from the collection container 04 is automatically effected. Hence, the operation of mounting or removing the collection container 04 is made easier to perform.

The aforementioned cover 06 is generally of a type which opens or closes by being swung about a certain fulcrum. However, the cover 06 may be of such as a type which opens or closes by being slid, as necessary. At this time, it is possible to cope with the case by adopting a mechanism (07) which is disposed between the cover 06 and the transporting part 05, and which is capable of converting the motion (such as rotational motion) accompanying the opening/closing operation of the cover 06 to power acting in a direction necessary for displacement of the transporting part 05 to each of the aforementioned positions (e.g., in a direction of arrow H) and of transmitting it to the transporting part 05. In addition, in such an image forming apparatus, in a case where it is necessary to displace the collecting-developing-agent occurring part 03 to a position spaced apart from the replacement part 02 at the time of the mounting or removing of the replacement part 02, the collecting-developing-agent occurring part 03 may also be mounted so as to be displaced to a position close to the replacement part 02 and a position spaced apart from the replacement part 02, respectively, in interlocked relation to the opening/closing operation of the cover 06, in the same way as the aforementioned transporting part 05.

Furthermore, in the image forming apparatus in accordance with the invention, it is preferable to provide a first detection portion that detects a replacement period of the collection container 04, and a second detection portion that detects a replacement period of the replacement part 02 on which the collection container 04 is mounted. Also, it is preferable to provide a portion that issues information prompting replacement of the replacement part 02 when either one of the first detection portion and the second detection portion detects the replacement period. The portion that issues information prompting replacement is, for example, a display portion for displaying a message or the like for prompting the replacement, or a portion for transmitting signal information for prompting the replacement to a predetermined processing unit. In this case, when at least one of the replacement part 02 and the collection container 04 reaches a replacement period, the user or the like replaces that replacement part 02 on the basis of the information prompting the replacement. At the same time, the collection container 04 which is in a state of being integrated with the replacement part 02 is also replaced, so that this arrangement is convenient.

A condition may be set such that the second detection portion for the replacement part 02 detects the replacement period at an earlier timing than the first detection portion for the collection container 04. In this case, for instance, even if a detection portion having low detection accuracy is adopted as the first detection portion, the collection container 04 subject to detection, together with the replacement part 02, can be replaced reliably before the collection container 04 becomes filled up.

According to the above-described image forming apparatus in accordance with the invention, as shown in FIG. 1B, if the replacement part 02 with the collection container 04 attached thereto is removed from the apparatus body 01A for replacement, the collection container 04 is also removed simultaneously from the apparatus body 01A integrally with that replacement part 02. Then, the replacement part 02 and the collection container 04 thus removed are appropriately disposed of, while a new replacement part and collection container in an integrated state are mounted in the apparatus 10A, instead. Thus, the collection container 04 is replaced simultaneously with the replacement part 02.

As a result, it becomes possible for the user of the image forming apparatus to simultaneously perform the replacement operation of the collection container 04 and the replacement operation of the replacement part 02 in one process without needing to perform them separately. Therefore, the troublesomeness involved at the time of the maintenance of the collection container 04 and the like is alleviated, and convenience enhances.

Figure 2:
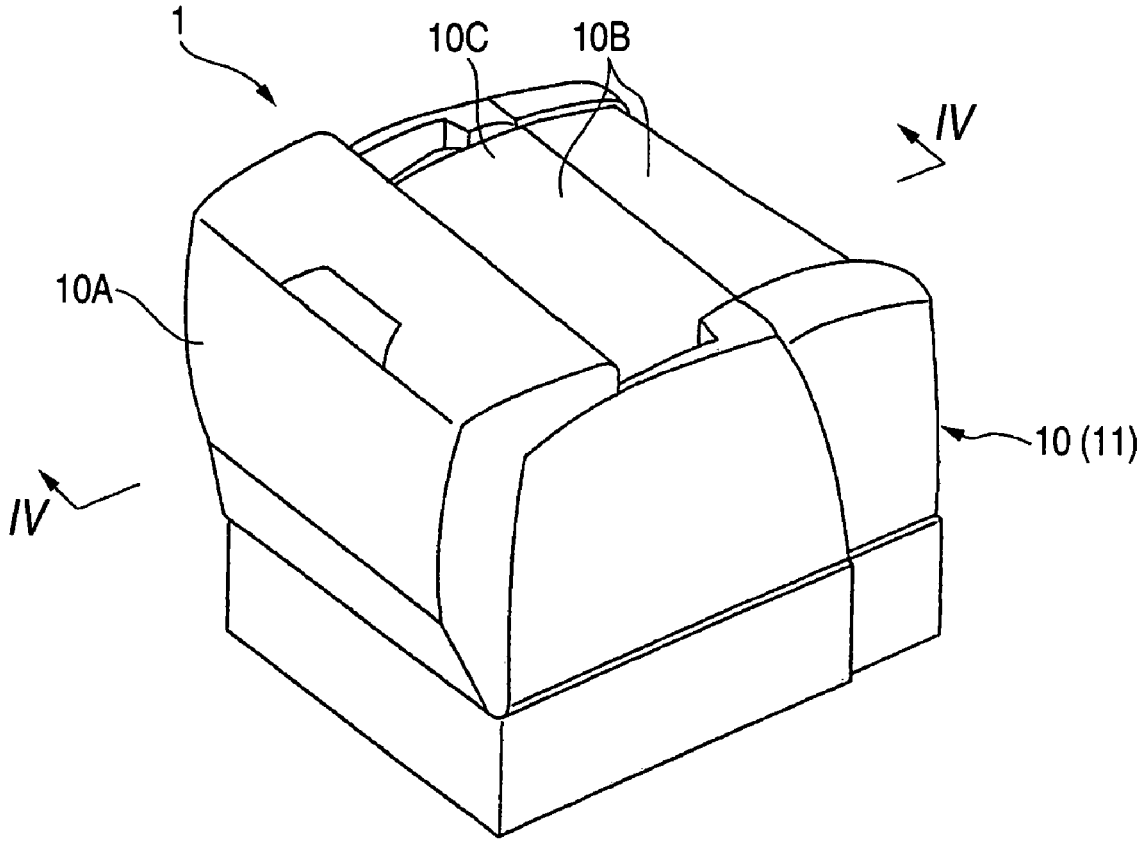
FIG. 2 is a perspective view illustrating a color printer in accordance with an example of the invention.
Figure 3:
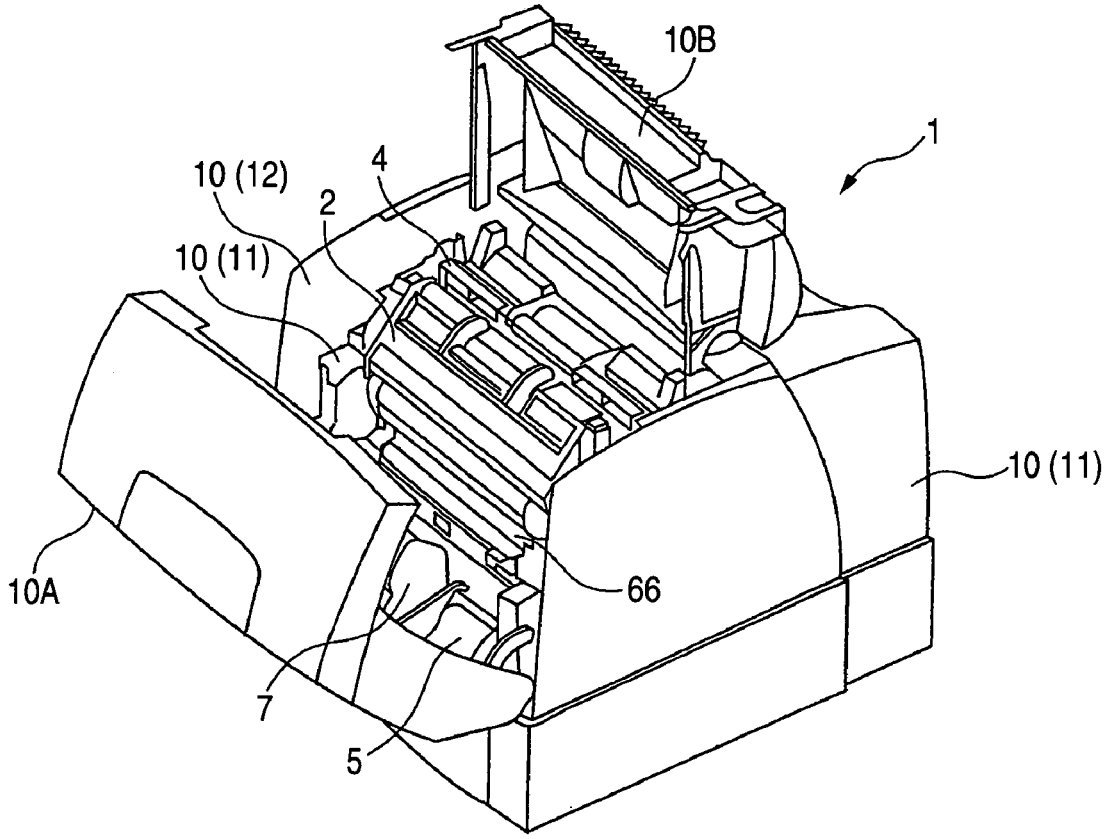
FIG. 3 is a perspective view illustrating a state in which opening/closing covers of the color printer shown in FIG. 2 are opened.
Figure 4:
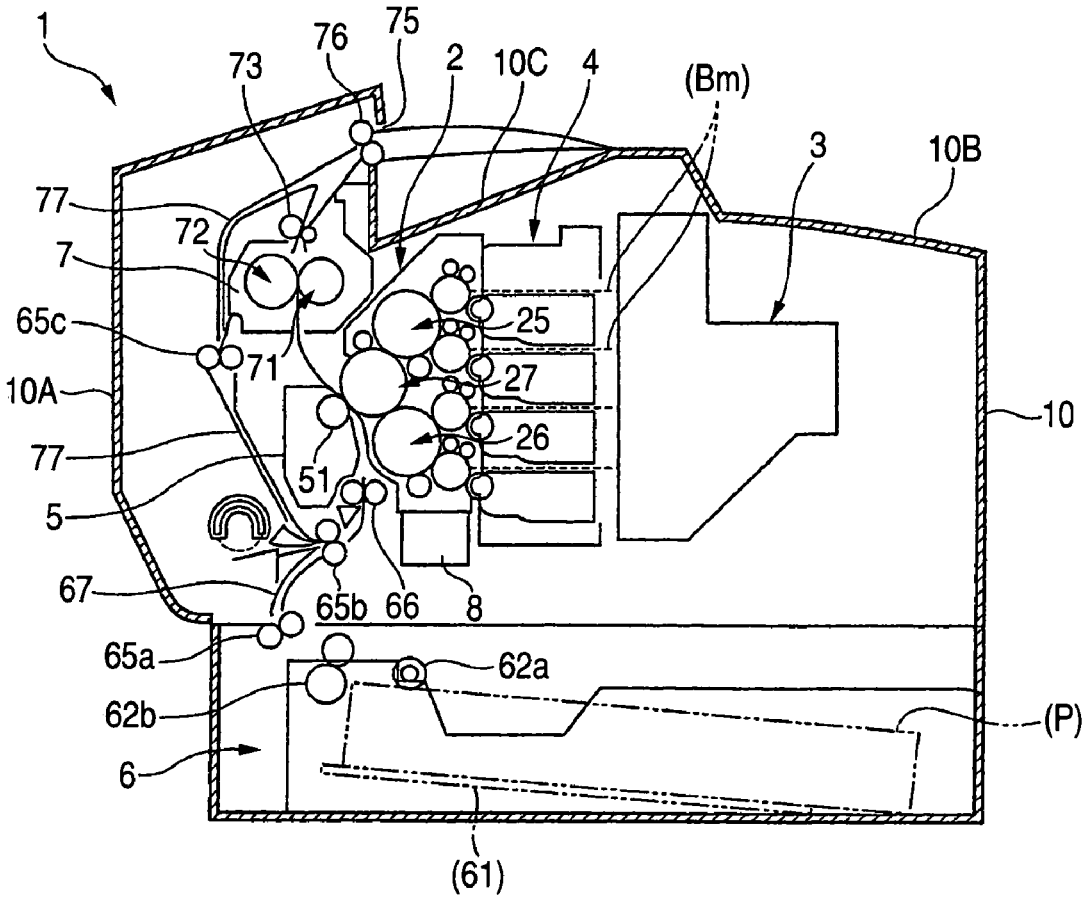
FIG. 4 is a schematic cross-sectional view, taken along line IV—IV, of the color printer shown in FIG. 2.
Figure 5:
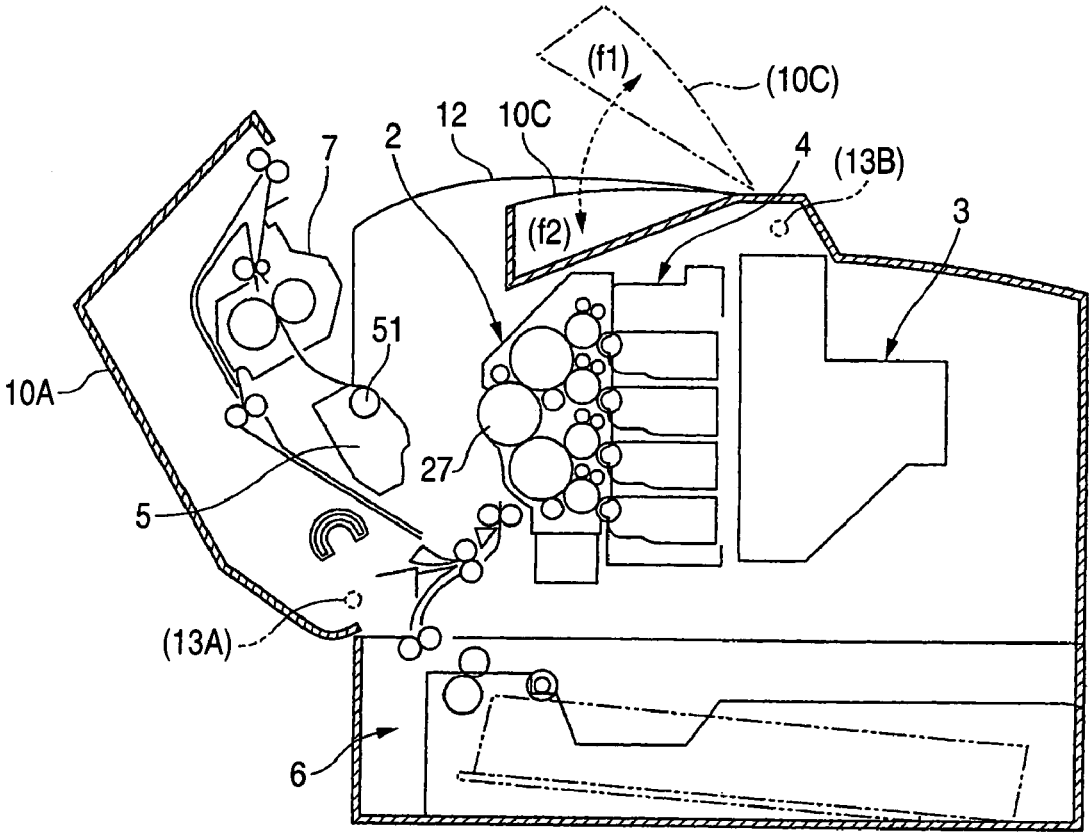
FIG. 5 is a schematic diagram illustrating a state in which the opening/closing covers shown in FIG. 4 are opened.
Figure 6:
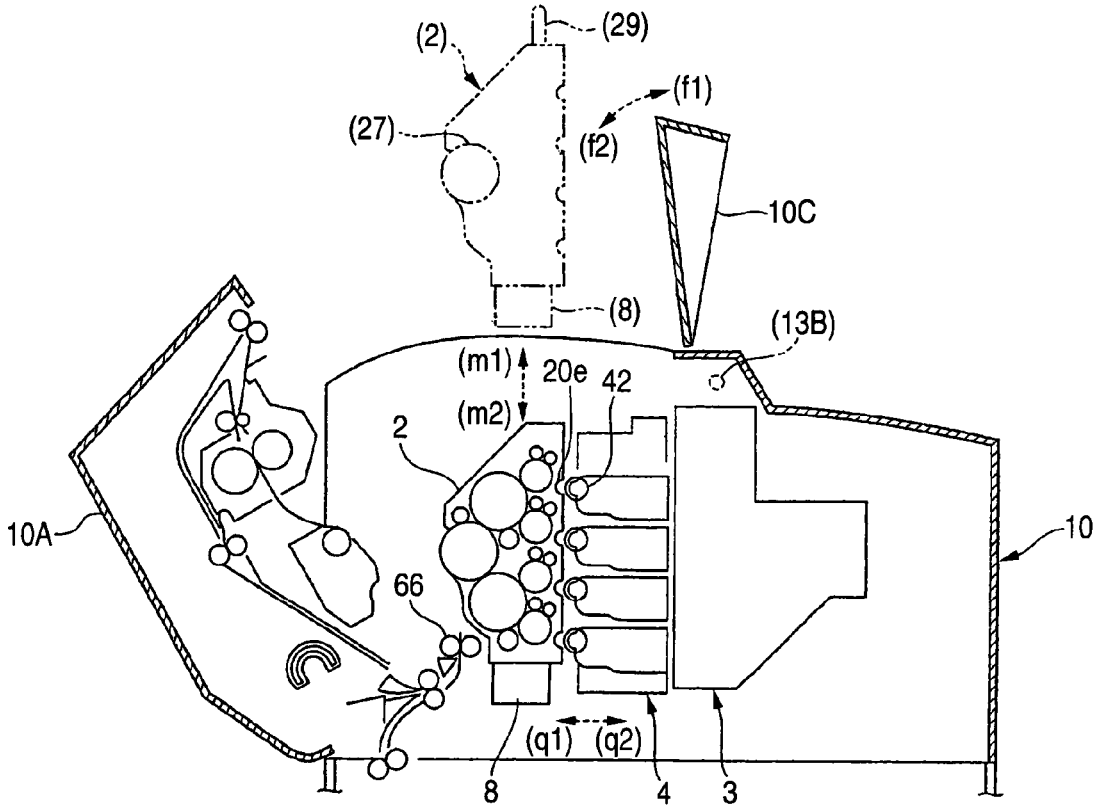
FIG. 6 is a schematic diagram illustrating a state in which the opening/closing covers necessary for removing an image carrying unit and the like shown in FIG. 4 are opened.

FIGS. 2 to 6 show a color printer in accordance with an example of the invention. Of these drawings, FIG. 2 is an external perspective view illustrating the whole of that color printer 1 (a state in which opening/closing covers are closed). FIG. 3 is an external perspective view illustrating a state in which the opening/closing covers are opened. FIG. 4 is a schematic cross-sectional view taken along line IV—IV in FIG. 2. FIG. 5 is a schematic cross-sectional view illustrating a state in which the opening/closing covers are opened. FIG. 6 is a schematic cross-sectional view illustrating a state in which the opening/closing covers are opened and replacement parts are mounted or removed.

<Overall Configuration of Printer>

This color printer 1 is a so-called tandem type printer in which imaging engines for exclusively forming toner images consisting of four colors of yellow (Y), magenta (M), cyan (C), and black (K) are arranged in series. The color printer 1 is capable of printing color (multi-color) images formed by appropriately combining toner images of the above-mentioned four colors, in addition to monochrome (mainly black color) images.

As shown in FIG. 4 and other drawings, this printer 1 has a configuration in which an image carrying unit 2, an exposure unit 3, and a development unit 4 which make up an imaging engine, as well as a final transfer unit 5, a paper feeding unit 6, a fixing unit 7, and the like are arranged in the internal space of its housing 10. Of these members, the housing 10 is a three-dimensional structure assembled into a predetermined shape and structure by using component parts such as a supporting frame 11, an exterior member 12, and the like. In this housing 10, as shown in FIGS. 2 and 3, one side surface portion in a substantially box-type external shape structured by the exterior member 12 is formed as an operating surface portion 10A for a user or the like of this printer 1 to perform predetermined operation by facing it. In addition, a part of its upper surface portion is formed as a paper discharging section 10B having an inclined surface, for accommodating recording paper P which is discharged after a part of its upper surface portion has been printed.

In addition, as shown in FIGS. 3, 5, and 6, this printer 1 is so structured that a portion (front cover) of the housing 10 formed as the operating surface portion 10A opens or closes by swinging about a pivot shaft 13A located on its lower side. Further, the printer 1 is so structured that its upper surface portion (top cover) 10C formed as a portion of the paper discharging section 10B opens or closes by swinging about a pivot shaft 13B located on its one end side. As for the operating surface portion 10A, the arrangement provided is such that the final transfer unit 5 and the fixing unit 7 are mounted thereon, and are integrally swung and displaced at the time of the opening or closing operation of the operating surface portion 10A. Since such an opening/closing structure is adopted, the predetermined component parts (e.g., the image carrying unit 2 and the development unit 4) disposed in the internal space of the housing 10 can be set in an exposed state. In this state, it is possible to perform required operations (maintenance operation, jammed-paper removing operation, etc.). Further, in this printer 1, since the image carrying unit 2 is handled as a replacement part, the image carrying unit 2 is mounted removably with respect to the housing 10, as shown in FIG. 6, among others.

Figure 7:
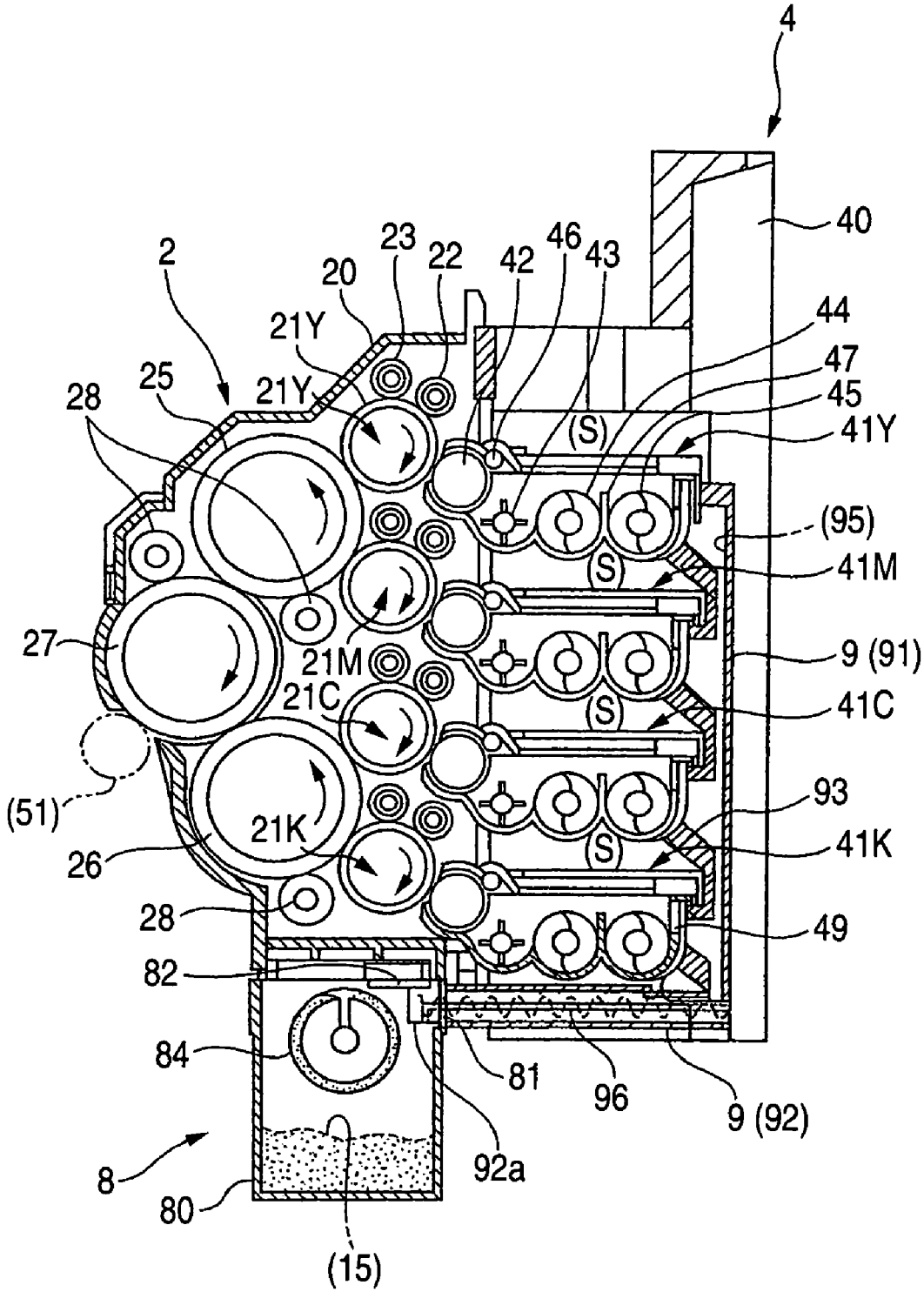
FIG. 7 is a schematic cross-sectional view illustrating the image carrying unit and a collection box in an integrated state.
Figure 8:
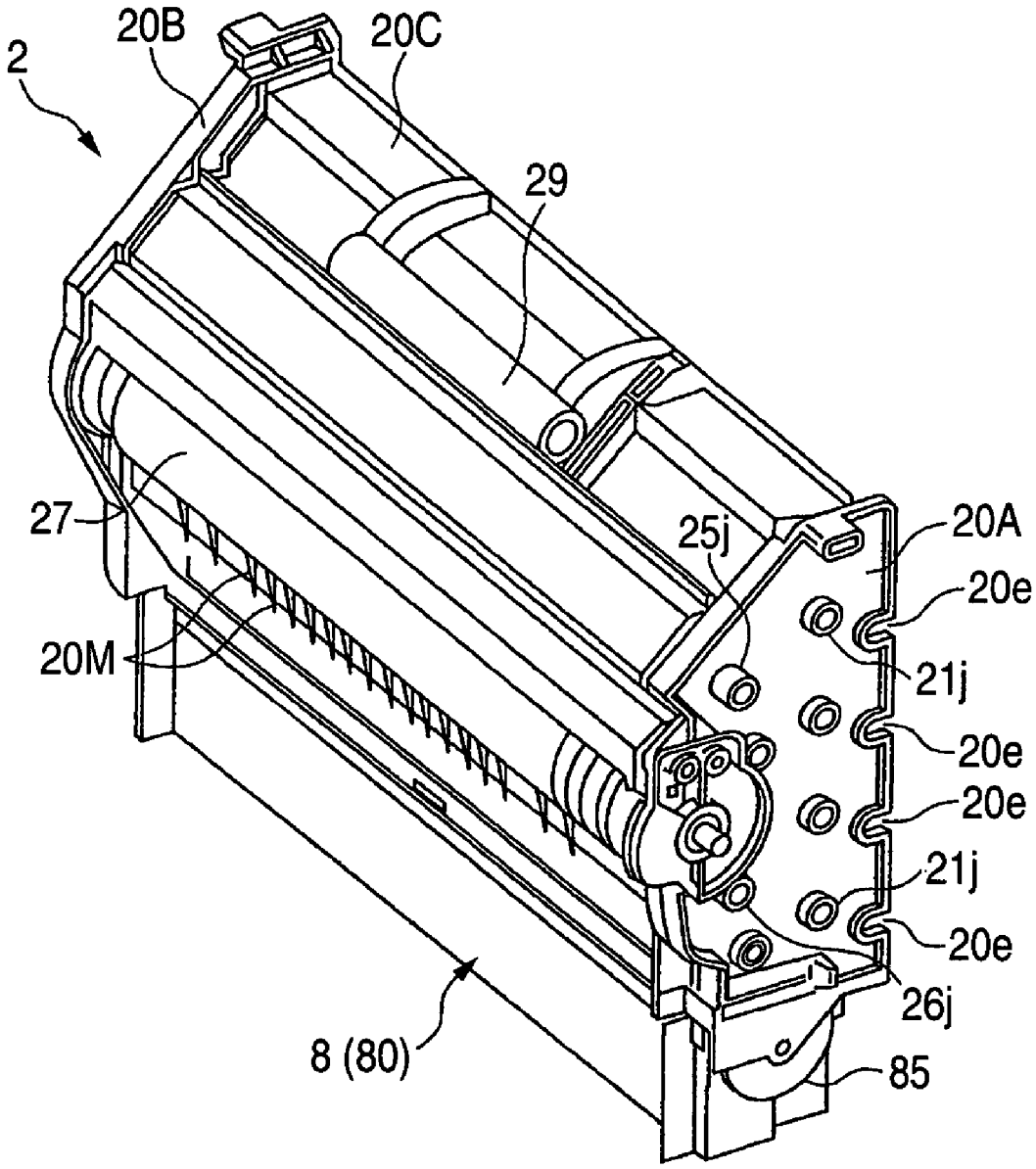
FIG. 8 is a perspective view illustrating the image carrying unit and the collection box in the integrated state.

The image carrying unit 2 among the aforementioned units is a process cartridge in which image carriers, such as a photoconductor and an intermediate transfer unit, mainly involved in the image formation process and capable of carrying toner images of the aforementioned four colors, are integrally mounted, and which requires replacement operation in correspondence with such as the stage when the life of that image carrier has been reached. As shown in FIGS. 4, 7, and 8, among others, the following are respectively mounted rotatably in a unit frame 20 of a form having an internal space whose vertical sectional shape is substantially trapezoidal: four photoconductor drums 21Y, 21M, 21C, and 21K on which toner images of four colors (Y, M, C, and K) are exclusively formed, charging rollers 22 for charging peripheral surfaces of the respective photoconductor drums 21 (Y, M, C, and K) to a predetermined background potential; toner-temporarily-holding brush rollers 23 for temporarily holding the toner and the like remaining on and adhering to the peripheral surfaces of the respective photoconductor drums 21; two first intermediate transfer drums 25 and 26 for transferring and carrying the toner images on the four photoconductor drums 21; a second intermediate transfer drum 27 for transferring and carrying the toner images on the two first intermediate transfer drums 25 and 26; and toner-temporarily-holding brush rollers 28 for respectively temporarily holding the toner and the like remaining on and adhering to the peripheral surfaces of the respective intermediate transfer drums 25, 26, and 27.

A first transfer bias for maintaining the drum surface potential to a predetermined potential (e.g., +250–500 V or thereabouts) is applied from an unillustrated bias power supply to the first intermediate transfer drums 25 and 26 in order to allow the toner images on the photoconductor drums 21 to be primarily transferred electrostatically onto the two transfer drums, respectively. Also, a second transfer bias for maintaining the drum surface potential to a predetermined potential (e.g., +650–1200 V or thereabouts) is applied from the unillustrated bias power supply to the second intermediate transfer drum 27 in order to allow the toner images on the first intermediate transfer drums 25 and 26 to be secondarily transferred electrostatically onto that drum.

In addition, as shown in FIG. 8, the image carrying unit 2 is provided with a tilting-accommodated type handle 29 on an upper surface portion 20C of its unit frame 20. The arrangement provided is such that the operation of mounting or removing the image carrying unit 2 is performed in a state in which this handle 29 is raised and manually held. Further, the image carrying unit 2 is arranged such that side portions 20A and 20B and a lower portion of its unit frame are removably positioned and held with respect to the mounting space portion for the image carrying unit in the housing 10. As a result, in the state in which the opening/closing cover 10C on the upper surface side of the housing 10 is opened, as shown in FIG. 6, the image carrying unit 2 can be removed from the housing 10 in such a manner as to be pulled up substantially vertically, or can be mounted by being accommodated in the mounting portion in the housing 10 by being lowered substantially vertically.

In FIG. 8 and other drawings, reference numeral 20*e* denotes a bearing holding groove for fitting and holding a bearing portion (42*a*) of the development roller 42 in the development unit 4, which is formed in each of the side portions 20A and 20B of the unit frame 20 and which will be described later. Further, reference numeral 21*a* denotes a bearing of the photoconductor drum 21, and 25*a*, 26*a*, and 27*a* denotes bearings of the intermediate transfer drums 25, 26, and 27. Furthermore, reference numeral 20M denotes a paper transport guide rib for guiding the recording paper P being transported to a final transfer position formed by the second intermediate transfer drum 27.

The exposure unit 3 is for writing electrostatic latent images by effecting exposure with respect to each photoconductor drum 21 of the image carrying unit 2. As shown in FIG. 4, the exposure unit 3 is installed in a state of being fixed to the housing 10 on the disposed side of the photoconductor drums of the image carrying unit 2 with the development unit 4 interposed therebetween. This exposure unit 3 is constructed such that optical system parts and the like are appropriately disposed in an internal space of a box-shaped unit housing, as shown in FIG. 4 and other drawings. The optical system parts include a light source such as an unillustrated semiconductor laser, as well as a polygon mirror, a reflecting mirror, various lenses, and the like for effecting scanning exposure by leading a light beam Bm emitted from the light source onto each photoconductor drum 21, i.e., an object of exposure, on the basis of image information. In addition, an image signal after (color) image information inputted to the printer 1 has been subjected to predetermined image processing by an unillustrated image processing portion is inputted to the exposure unit 3.

The above-described exposure unit 3 is adapted to form electrostatic latent images at predetermined potentials on the respective photoconductor drums 21 as the photoconductor drums 21 are respectively subjected to scanning exposure with the aforementioned light beam Bm (see FIG. 4) through exposure gaps S (see FIG. 7) in the development unit 4.

Figure 9:
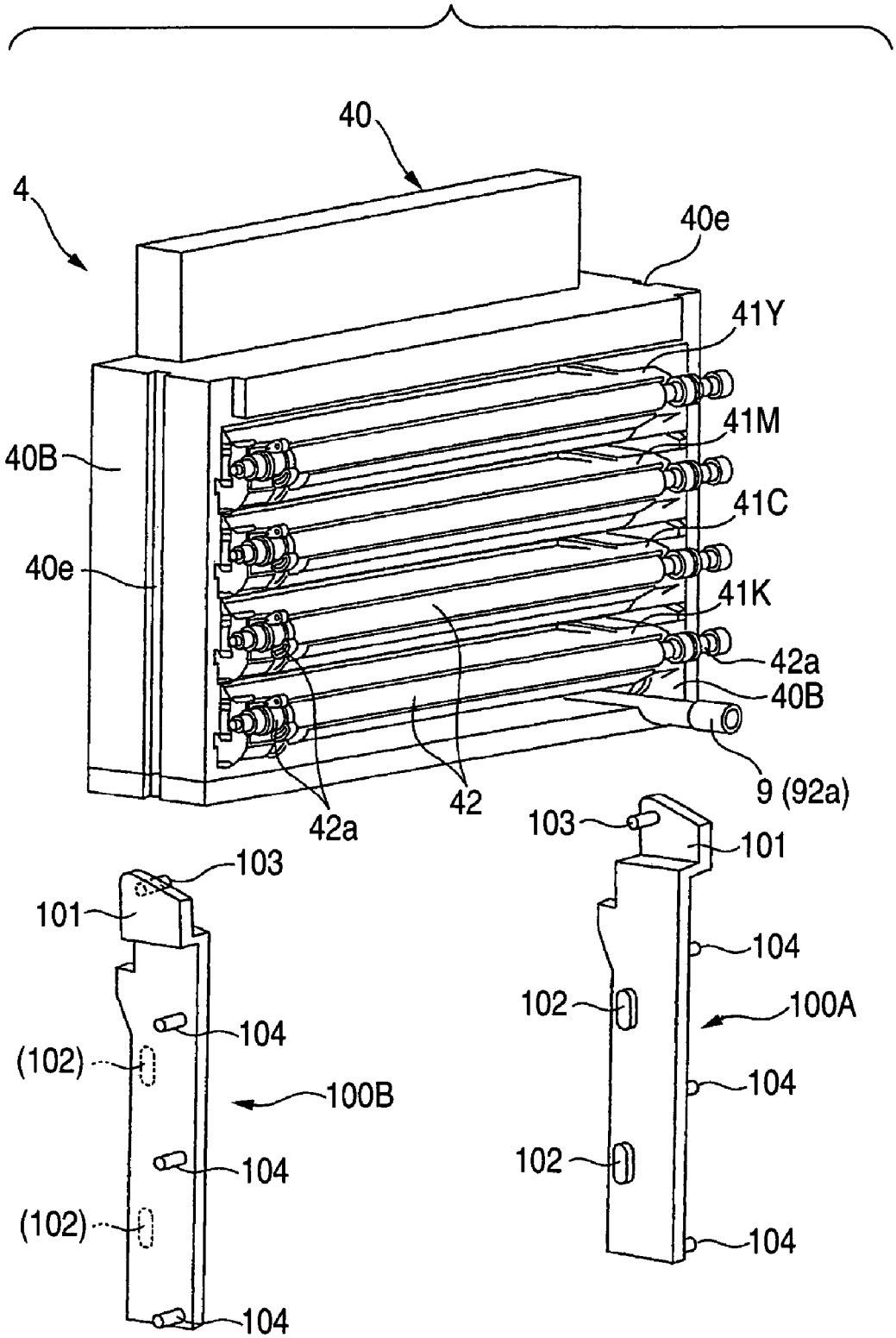
FIG. 9 is a perspective view illustrating a development unit and guide plates.

The development unit 4 is for developing by means of developing agents electrostatic latent images formed on the respective photoconductor drums 21 of the image carrying unit 2 by exposure from the exposure unit 3. As shown in FIG. 4, the development unit 4 is installed between the image carrying unit 2 and the exposure unit 3. As shown in FIGS. 7 and 9, among others, this development unit 4 is constructed such that four developing devices 41Y, 41M, 41C, and 42K for effecting development with developing agents of the four colors (Y, M, C, and K) are mounted in the space of a frame type unit frame (subframe) 40 in which a rectangular parallelepiped-shaped space is formed, in a positional relationship of being vertically juxtaposed with intervals each provided between adjacent ones so as to be set in a face-to-face relation to the respective photoconductor drums 21. The penetrating optical path space S for passage of the light beam Bm for exposure from the exposure unit 3 toward the photoconductor drum 21 of the image carrying unit 2 is secured (formed) on an upper portion side of each developing device 41.

Figure 10:
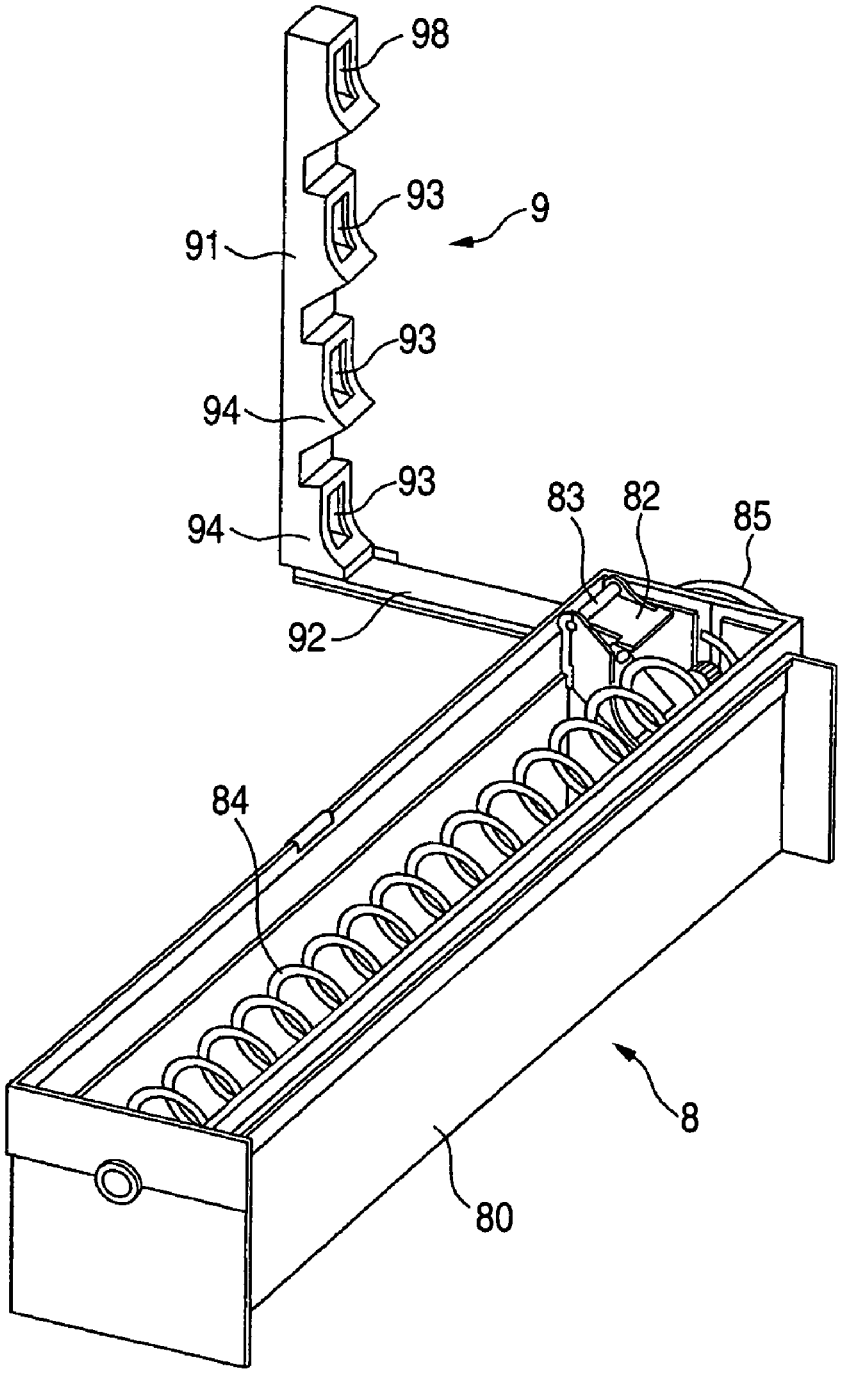
FIG. 10 is a perspective view illustrating the collection box and a developing-agent transporting part.

Each of the developing devices 41 (Y, M, C, and K) is a two-component developing device for effecting so-called magnetic brush development using a two-component developing agent containing (nonmagnetic) toner and a (magnetic) carrier. As shown in FIGS. 7 and 10, among others, this developing device 41 is mainly configured from a development roller 42 which is rotatively driven in close proximity to and in face-to-face relation to the photoconductor drum 21 while maintaining a predetermined very small gap therebetween; a paddle 43 which rotates so as to supply the two-component developing agent to this development roller 42; two augers 44 and 45 which rotate so as to circulatingly transport to the paddle 42 side the two-component developing agent accommodated in a developing-agent circulating/accommodating portion of the developing device 41 while stirring it; and a layer-thickness restricting member 46 for restricting the two-component developing agent supplied to the development roller 42 to a fixed layer thickness. These component members are disposed in a housing of the developing device 41. Further, a development bias voltage in which a dc component is superposed on an ac component is adapted to be applied to the development roller 42 from an unillustrated bias power supply.

The development roller 42 is formed by fitting a magnet roller inside a cylindrical rotating sleeve. The paddle 43 is formed such that a plurality of plate vanes are uprightly provided radially on a rotating shaft along its axial direction. The augers 44 and 45 are formed by spirally winding a transporting vane around a rotating shaft. The developing-agent circulating/accommodating portion is formed by partitioning a portion of the device housing into two circulating/transporting recesses 48A and 48B which are parallel to each other with a central partition wall 47 disposed therebetween and which communicate with each other at their both ends. The augers 44 and 45 are respectively installed in the circulating/transporting recesses 48A and 48B such as to be rotatably accommodated therein (see FIG. 11; the white arrows in the drawing indicate the direction in which the developing agent is circulatingly transported).

In addition, the developing devices 41 loaded in the unit frame 40 are so structured that, when in use, the bearing portions 42*a* of the development rollers 42 are respectively fitted in the bearing holding grooves 20*e* in the unit frame side portions 20A and 20B of the image carrying unit 2 in such a manner as to be capable of being pulled out. Consequently, the development rollers 42 are arranged to be properly positioned in a state of being spaced a predetermined interval from the photoconductor drums 21 of the image carrying unit 2.

In such a development unit 4, when the two-component developing agent is stirred and transported by the augers 44 and 45 in each developing device 41 and is supplied to the development roller 42 through the paddle 43, the passage of the layer-thickness restricting member 46 on the development roller 42 forms a magnetic brush restricted to a fixed layer thickness. Subsequently, the two-component developing agent constituted by that magnetic brush is passed in such a manner as to be brought into slidingly frictional contact with the surface of the photoconductor drum 21 in the state in which the development bias is applied thereto. Consequently, the toner in the magnetic brush is electrostatically adhered only to the electrostatic latent image portion *image portion) on the photoconductor drum 21, thereby forming a toner image.

The final transfer unit 5 is for finally transferring onto the recording paper P the toner image transferred and formed on the second intermediate transfer drum 27 in the image carrying unit 2, and is installed in the housing 10 serving as the operating surface portion 10A. This final transfer unit 5 is mainly constructed as a final transfer roller 51 for forming a transfer nip portion by abutting against the second intermediate transfer drum 27 is rotatively mounted in its unit frame. A second transfer bias for finally transferring the toner images on the second intermediate transfer drum 27 electrostatically onto the recording paper P is applied to that final transfer roller 51 from the unillustrated bias power supply. In addition, the final transfer roller 51 is provided with a cleaning device such as a cleaning blade.

The paper feeding unit 6 is mainly configured from a paper feed tray 60 for stacking and accommodating the plurality of sheets of recording paper P, as well as a feeding out mechanism 62 including a pickup roller 62*a*, separation rollers 62*b*, and the like for feeding out one by one the sheets of recording paper P stacked in this paper feed tray 60. The recording paper P fed out from this paper feeding unit 6 is transported and fed at a predetermined timing into a nip between the second intermediate transfer drum 27 of the image carrying unit 2 and the final transfer roller 51 of the final transfer unit 5 through paper feeding paths 67 consisting of pairs of paper feeding rollers 65*a* and 66*b*, a pair of registration rollers 66, paper transport guides, and the like.

The fixing unit 7 is mainly configured from a unit frame; a heating roller 71 with a heating lamp incorporated in the interior of the roller space; a pressure roller 72 which rotates in pressure contact with this heating roller 71; and a paper discharging roller 73. In FIG. 4, reference numeral 75 denotes a paper discharge port for discharging the fixed recording paper P into the aforementioned paper discharging section 10B; 76, a pair of discharge rollers for discharging the fixed recording paper P into the paper discharging section 10B; and 77, an inverting refeeding path at the time of double-sided printing formed by a pair of paper transport rollers 65*c*, paper transport guides, and the like.

<Configuration Concerning Collection of Developing Agents Occurring in Trickle Phenomenon>

Figure 11:
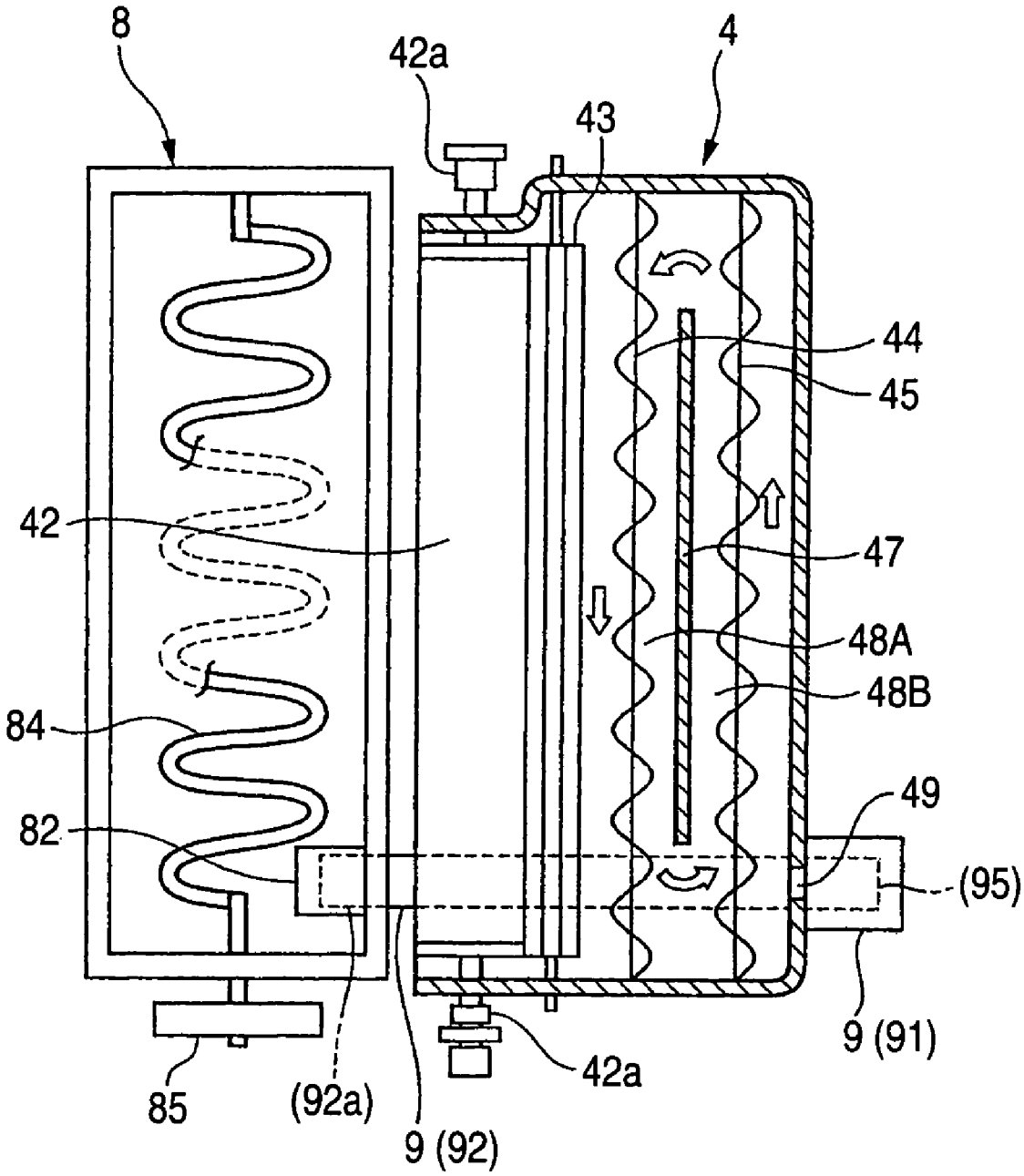
Figure 12:
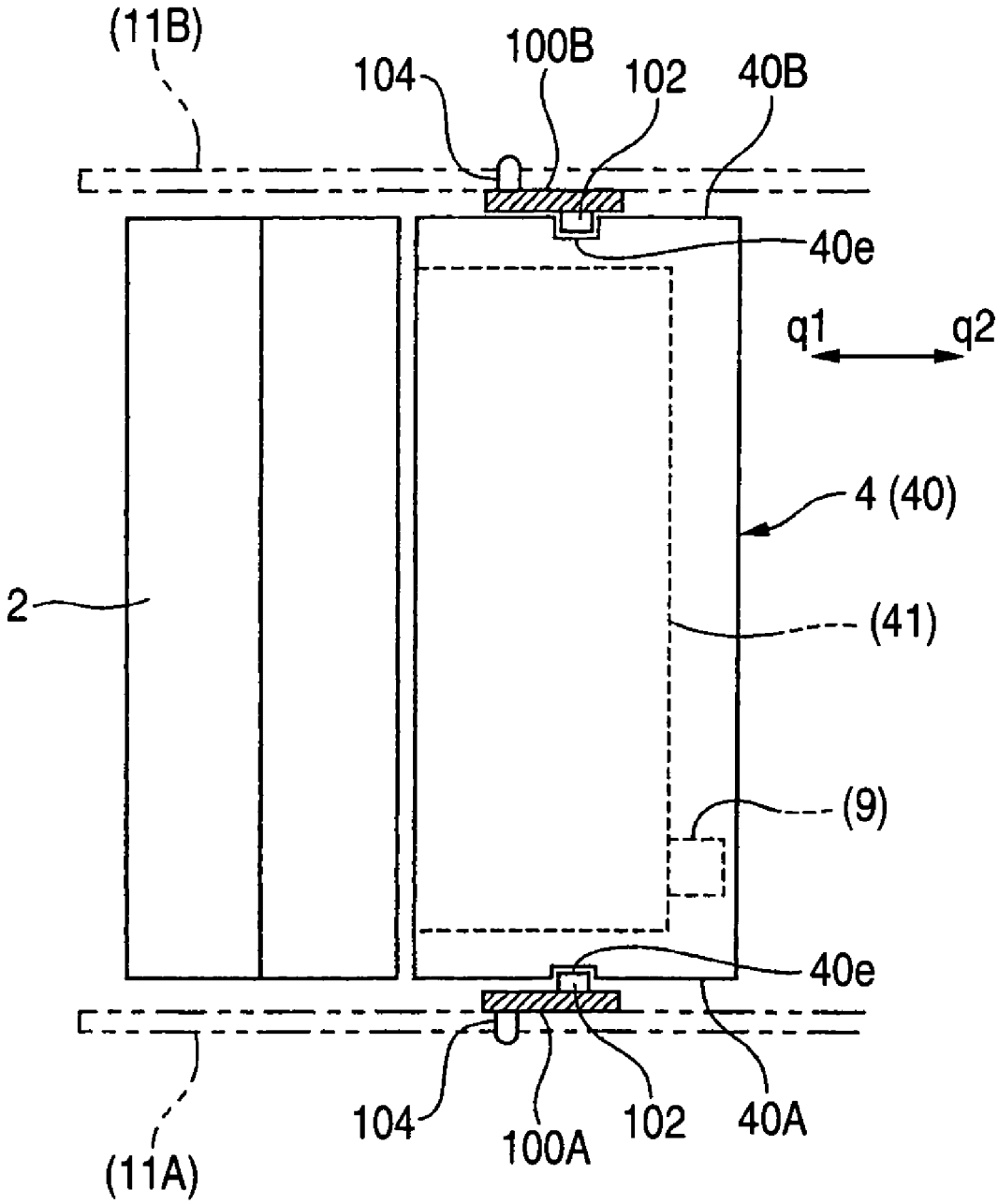
FIG. 12 is an explanatory diagram illustrating a mounting structure capable of displacing the development unit.

As shown in FIGS. 7, 10, 11, and the other drawings, this color printer 1 uses two-component developing devices which adopt the trickle phenomenon system already described as the four developing devices 41 (Y, M, C, and K) in the development unit 4. As a result of the adoption of the trickle development system, all of an excessive two-component developing agent (collecting developing agent) 15, which is discharged so as to overflow from each of the developing devices 41, is arranged to be collectively collected in one developing agent collection box 8 installed on a lower portion (bottom) side of the image carrying unit 2. The collecting developing agent 15 discharged from each developing device 41 is transported by a tubular developing-agent transporting part 9 connecting each developing device 41 and the developing agent collection box 8.

First, in the light of the fact that the trickle development system is adopted, in the developing device 41, the two-component developing agent containing not only the toner but the carrier is replenished. This replenishment is effected as such a two-component developing agent is transported by appropriate amounts at predetermined timings from an unillustrated two-component-developing-agent container (cartridge type bottle) to a predetermined portion in the developing-agent circulating/accommodating portion 48B through a developing-agent replenishing unit. Meanwhile, a developing-agent discharge port 49 for causing a portion (excessive portion) of the two-component developing agent circulatingly transported by the augers 45 to overflow is formed in one end of that developing-agent circulating/accommodating portion 48B.

The developing agent collection box 8 consists of a box body 80 whose upper surface portion is open and which is formed into a rectangular parallelepiped shape so as to assume a size substantially equal to the size of the bottom portion of the image carrying unit 2. The box body 80 has its open upper surface portion removably installed on the bottom portion of the unit frame 20 of the image carrying unit 2 and integrated therewith.

In this-box body 80, a joint port 81 with respect to the developing-agent transporting part 9 is formed in a side wall surface of one longitudinal end thereof, and an opening/closing cover 82 is provided for opening or closing the joint port 81 by swinging about a certain pivot shaft 83 by the joining operation of the developing-agent transporting part 9. The opening/closing cover 82 is urged in the direction of closing the joint port 81 by a helical spring. Further, in a developing agent accommodating space of the box body 80, a developing-agent stirring/leveling member 84 of a form in which a wire is wound spirally along its longitudinal direction is provided so as to be rotatively driven. Reference numeral 85 in the drawings denotes a drive gear for rotating the developing-agent stirring/leveling member 84 by receiving a rotating force of a drive system of the developing device 41, for example.

The developing-agent transporting part 9 is mainly configured from a collecting tubular portion 91 for collecting the two-component developing agent flowing out from the above-mentioned developing-agent discharge port 49 of each developing device 41 by allowing it to drop naturally, as well as a transporting tubular portion 92 for transporting the two-component developing agent collected by this collecting tubular portion 91 to the developing agent collection box 8.

The collecting tubular portion 91 is formed such that connecting portions 94 each having a developing-agent receiving port 93, which is connected to the developing-agent discharge port 49 from diagonally below by coming into close contact with a rear portion of each developing device 41, are formed in a tubular body of a hollow structure which is disposed in such a way as to continue to rear portions (ends opposite to the ends where the development rollers 42 are installed) of the four developing devices 41 (Y, M, C, and K) . The interior of this collecting tubular portion is a straight hollow 95 in which the collecting developing agents drop naturally. Meanwhile, the transporting tubular portion 92 is arranged such that, in the internal space of a cylindrical tubular body having one end communicatingly connected to a lower end of the collecting tubular portion 91, a rotatively transporting member (e.g., auger) 96 is provided so as to be rotatively driven for transporting toward the collection box 8 side the two-component developing agent which is collected and drops in that collecting tubular portion 91. As for the transporting tubular portion 92, its tip portion 92*a* is inserted in the aforementioned joint port 81 of the box body 80 of the collection box 8. The transporting tubular portion 92 is formed with such a dimensional shape as to be capable of pushing open the opening/closing cover 82 in the closed state when its tip portion 92*a* is inserted.

In addition, the developing-agent transporting part 9 is attached to the unit frame 40 of the development unit 4 in a fixed state. Specifically, as shown in FIGS. 7, 9, and 11, among others, the attachment is effected such that the collecting tubular portion 91 of the developing-agent transporting part 9 is set in a state of being connected to the rear portions of the respective developing devices 41 attached to the unit frame 40, while its transporting tubular portion 92 is passed in a lower portion of the lowest-stage developing device 41K such that its tip portion 92*a* projects to the side opposing the collection box 8.

Further, since the developing agent collection box 8 is mounted so as to be integral with the image carrying unit 2, i.e., a replacement part, at the time of replacement of the image carrying unit 2, the tip portion 92*a* of the transporting tubular portion 92 is displaced to a position spaced apart from the collection box 8 (its joint port 81). Thus, no hindrance is caused to the operation of mounting or removing the image carrying unit 2 and the collection box 81

<Structure Whereby Developing-Agent Transporting Part is Displaced by Being Interlocked with Opening/Closing Operation of Opening/Closing Cover>

Particularly in this example, the following structure is adopted, as will be described below. The development unit 4 is displaced between a position spaced apart from the image carrying unit 2 (spaced apart position) and a position for joining the image carrying unit 2 (joined position) by being interlocked with the opening/closing operation of the upper surface opening/closing cover 10C, and the development-agent transporting part 9 attached to the unit 4 is also displaced simultaneously to the position spaced apart from the collection box 8 (spaced apart position)

Namely, as shown in FIGS. 9 and 11 to 14, the unit frame 40 of the development unit 4 is so devised as to be capable of being advanced or retracted between the spaced apart position and the joined position by a pair of guide plates 100A and 100B which are respectively disposed on its side surface sides and are adapted to move in such a manner as to be lifted or lowered diagonally by the opening/closing operation of the opening/closing cover 10C.

In this mechanism, as shown in FIG. 9 and other drawings, a slide groove 40*e* extending straightly is formed in each of side portions 40A and 40B of the unit frame 40 of the development unit 4 in such a manner as to penetrate vertically.

The pair of guide plates 100A and 100B are elongated plates of a shape each having a bent upper end portion 101 formed such that an upper end portion, after being once bent toward the outside, is bent again so as to rise vertically. Further, each of the guide plates 100A and 100B has a slidably engaging portion 102 on an inner surface of its plate body for slidably fitting in the aforementioned slide groove 40*e* of the unit frame 40. In addition, an engaging projection 103 for fitting in a cam groove (or hole) 15 formed in the opening/closing cover 10C is formed in an inner surface of that upper bent portion 101. Further, engaging projections 104 are formed on an outer surface of the plate body for slidably fitting in a plurality of inclined guide holes 16, which are formed in supporting frames 11A and 11B of the housing 10 respectively disposed on side surfaces of the development unit 4 or the like.

The cam grooves 15 of the opening/closing cover 10C and the inclined guide holes 16 of the supporting frames 11A and 11B are formed such that as the guide plates 100A and 100B are lifted by the opening operation (rotational motion) of the cover 10C about its pivot shaft 13B, the rotational motion is converted to the motion of diagonally upward displacement of the guide plates 100A and 100B in the direction of moving away from the image carrying unit 2. The cam groove 15 is formed so as to depict a substantially arcuate line which extends on the lower side of the pivot shaft 13B from a position spaced apart from the pivot shaft 13B and gradually approaches a position close to the pivot shaft 13B in the state in which the opening/closing cover 10C is closed. In addition, as for the inclined guide hole 16, as shown in FIGS. 13 to 15, its lower end portion is formed as a drop-in positioning hole portion 16*a* slightly extending straightly along a vertical direction, while an upper end portion above that drop-in positioning hole portion 16*a* is formed as an inclined elongated hole portion 16*b* which extends straightly diagonally upward at a predetermined angle in a direction of moving away from the image carrying unit 2.

The guide plates 100A and 100B are attached by fitting the engaging projections 103 at their upper bent portions 101 in the cam grooves 15 of the opening/closing cover 10C, respectively, and by fitting the plurality of engaging projections 104 on their plate bodies into the corresponding inclined guide holes 16 of the supporting frames 11A and 11B, respectively. As a result, the guide plates 101A and 100B are installed in a state of facing each other at a fixed interval therebetween so as to be located on both sides of the development unit 4 in the internal space of the housing 10.

Figure 13:
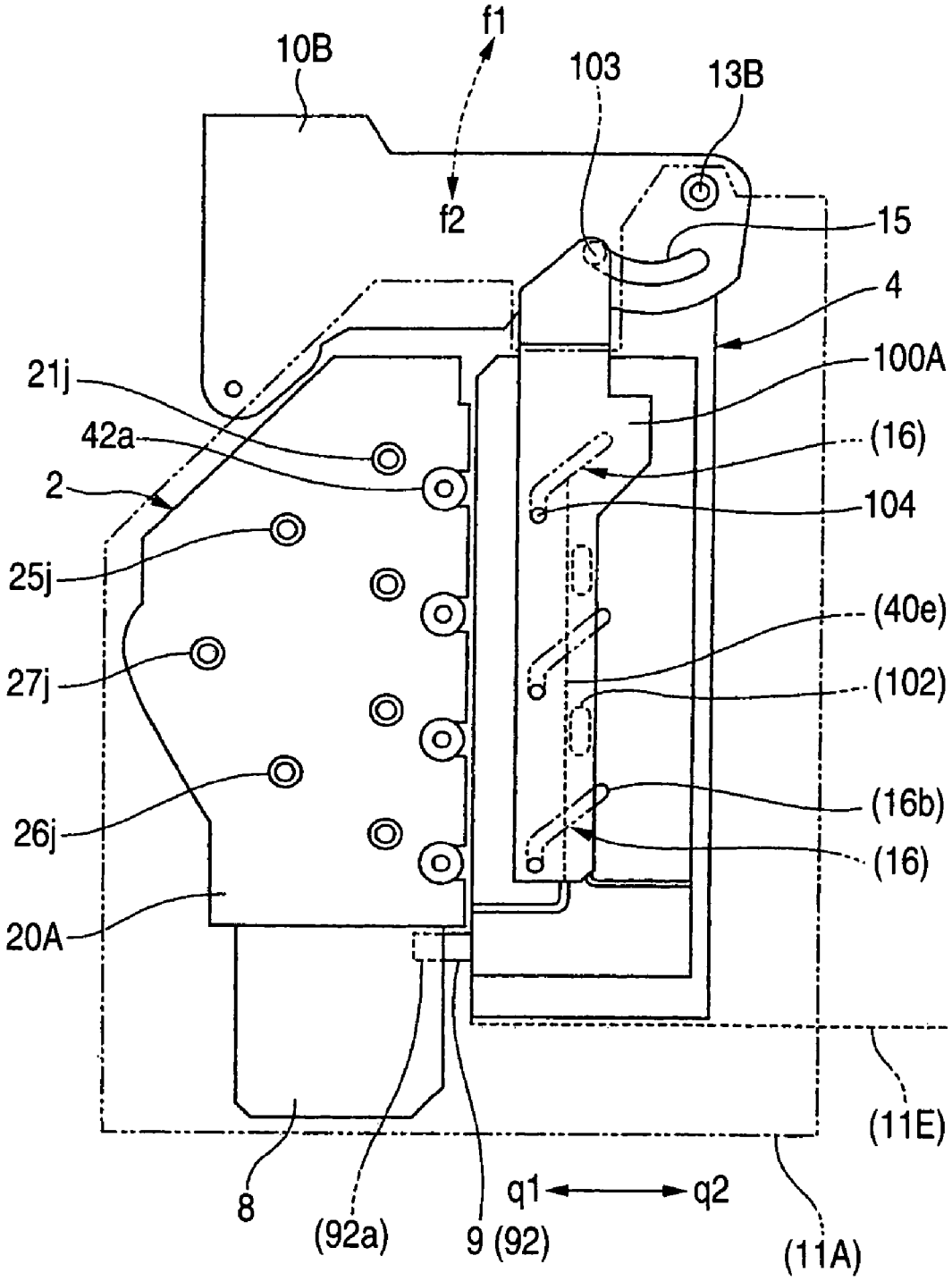
FIG. 13 is an explanatory diagram illustrating a state of the development unit and the developing-agent transporting part (a state of being in a joined position) when the opening/closing cover is closed.
Figure 14:
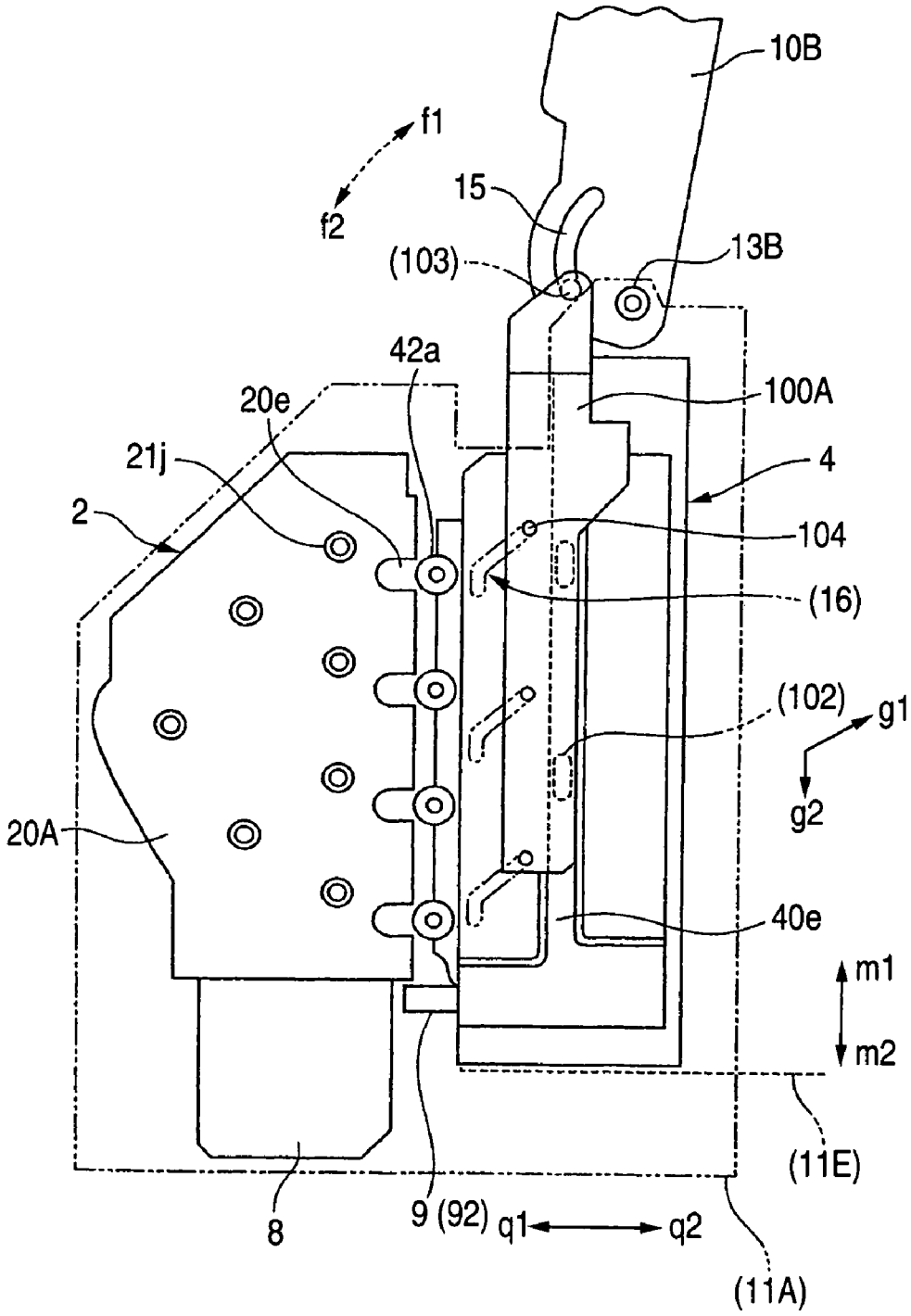
FIG. 14 is an explanatory diagram illustrating a state of the development unit and the developing-agent transporting part (a state of being in a spaced apart position) when the opening/closing cover is opened.
Figure 15:
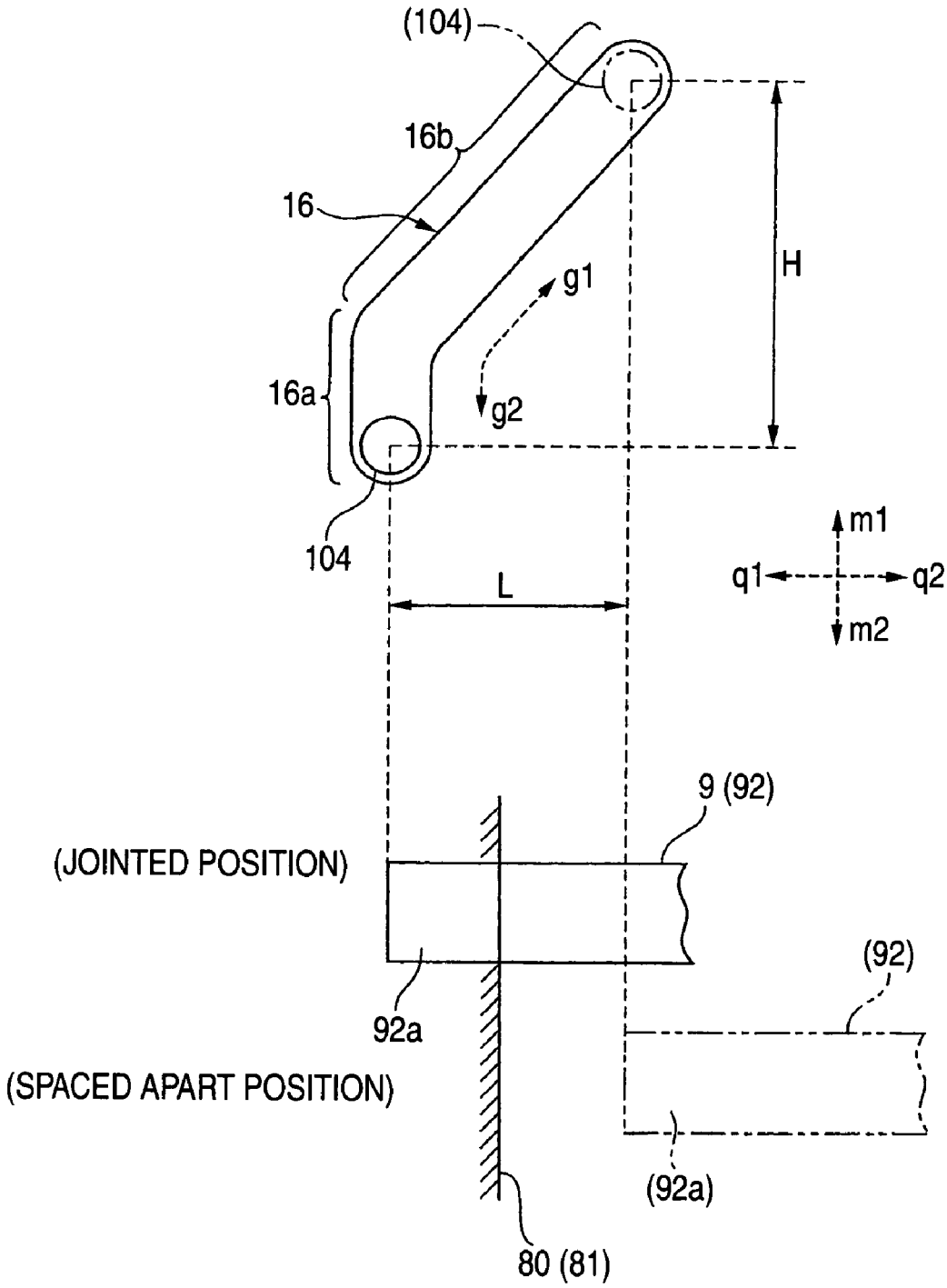
FIG. 15 is an explanatory diagram illustrating the movement of the guide plate and a state of the developing-agent transporting part accompanying the same (a state of being in the joined position or the spaced apart position)

As for the guide plates 100A and 100B installed in the above-described manner, if the opening/closing cover 10C is moved in an opening/closing direction f1 or f2 about its pivot shaft 13B, as shown in FIGS. 13 and 14, their engaging projections 103 are lifted or lowered in a state of being scooped up by the cam grooves 15. At the same time, their engaging projections 104 respectively move in a lifting or lowering direction g1 or g2 in such a manner as to move along the inclined guide holes 16. As a result, the entire guide plates 100A and 100B, when viewed from the fixed supporting frames 11A and 11B, move (are displaced) a distance H in a vertical direction m1 or m2, and concurrently move a distance L in a horizontal direction q1 or q2, as shown in FIG. 15. At this time, the guide plates 100A and 100B are positioned with respect to the horizontal direction q1 or q2 as their engaging projections 104 are positioned in the drop-in positioning hole portions 16*a* of the inclined guide holes 16.

Next, the development unit 4 is lowered from above into the space formed between the guide plates 100A and 100B in such an installed state, and the slidably engaging portions 102 on the respective plates 100 are fitted in the slide grooves 40*e* in both side surfaces of its unit frame 40. Consequently, the development unit 4 is supported in a state of being slidable in the vertical direction m1 or m2 with respect to the guide plates 100A and 100B.

It should be noted that the development unit 4 at this time is adapted to be positioned (restricted) with respect to its downward direction m2 by a horizontally installing surface portion 11E (see FIGS. 14 and 15) formed in the housing 10. This horizontally installing surface portion 11E is formed such that the bearing 42*a* of the development roller 42 in each developing device 41 of the development unit 4 is positioned at substantially the same height as the bearing holding groove 20*e* in each of the frame side portions 20A and 20B of the image carrying unit 2 with respect to the horizontal direction.

As for the development unit 4 supported by the guide plates 100A and 100B, if the opening/closing cover 10C is moved in the opening or closing direction f1 or f2 about its pivot shaft 13B, as shown in FIGS. 13 and 14, the guide plates 100A and 100B operate so as to move in the vertical direction m1 or m2 and in the horizontal direction q1 or q2, as described above. Consequently, the development unit 4 finally moves the same distance L in the horizontal direction q1 or q2 (in such a manner as to slide on the horizontally installing surface portion 11E) by being interlocked with the guide plates 100A and 100B. Incidentally, with respect to the movement of the guide plates 100A and 100B in the vertical direction m1 or m2, since the development unit 4 is slidably supported by the guide plates 100A and 100B the development unit 4, the development unit 4 remains mounted on the horizontally installing surface portion 11E and does not move in that direction.

Thus, in the printer 1, if the opening/closing cover 10C is operated to open or close, the development unit 4 moves in the horizontal direction m1 or m2 by means of the guide plates 100A and 100B, the development-agent transporting part 9 attached to the unit 4 also moves similarly in the horizontal direction m1 or m2 in an interlocking manner.

As a result, as shown in FIGS. 14 and 15, the tip portion 92*a* of the transporting tubular portion 92 in the developing-agent transporting part 9 moves in the horizontal direction m1 or m2 by being interlocked with the opening/closing operation of the opening/closing cover 10C. Therefore, the tip portion 92*a* of the transporting tubular portion 92 is adapted to be displaced between the position at which it is inserted in and jointed to the joint port 81 in the box body 80 of the collection box 8 (joined position) and the position at which it is pulled out of and spaced apart from the joint port 81 of that collection box 8 (spaced apart position). In addition, at this time, the bearing portions 42*a* of the development rollers 42 in the development unit 4 are displaced so as to be fitted in or pulled out of the bearing holding grooves 20*e* of the image carrying unit 2 (FIG. 13).

<Configuration Concerning Management of Replacement Period of Replacement Parts>

Figure 16:
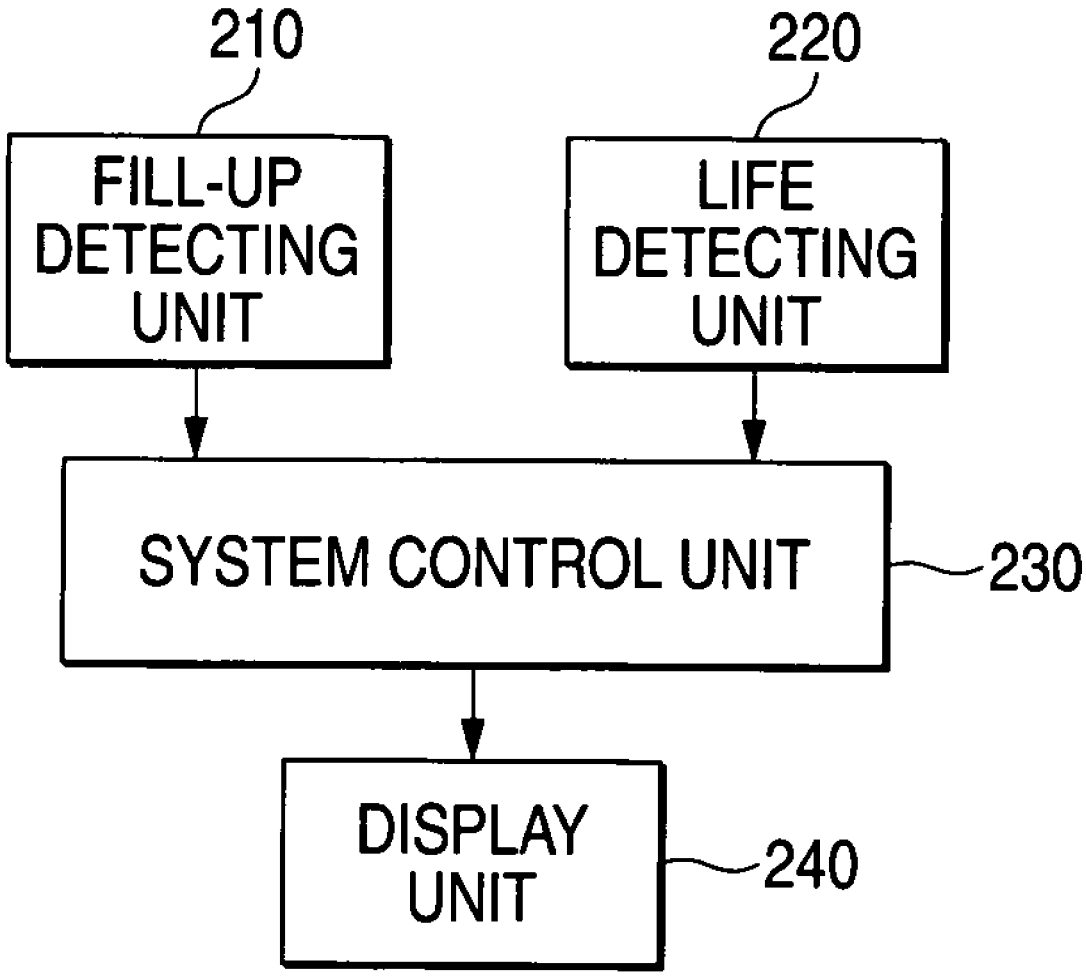
FIG. 16 is a block diagram illustrating a configuration of a control system concerning management of a replacement period.

In addition, as shown in FIG. 16, this printer 1 is provided with a fill-up detecting portion 210 for detecting whether or not the collection box 8 has become filled up with the collecting developing agents (reached a fill-up) and has reached a replacement period, as well as a life detecting portion 220 for detecting whether or not any of the photoconductor drums 21 and the like in the image carrying unit 2 is near the end of its useful life and a replacement period has been reached. As the fill-up detecting portion 210, an optical sensor is adopted which is capable of detecting the fill-up when a developing agent which is present at a portion of the fill-up among the developing agents collected into the box body 80 interrupts an optical path for detection. As the lift detecting portion 220, a counter consisting of software for accumulating and counting the number of sheets to be printed is used.

Further, detection information from the fill-up detecting portion 210 and the life detecting portion 220 is inputted to a system control unit 230 of the printer 1. The arrival of the replacement period is determined by the system control unit 230, and information prompting the replacement of the image carrying unit 2 (e.g., an alarm message) is displayed on a predetermined display unit 240.

The determination of the arrival of the replacement period by the system control unit 230 is effected on the basis of information on the detection of the arrival of the replacement period by either one of the two detecting portions 210 and 220. Specifically, the determination is effected when detection information indicating that a fill-up has been reached has been inputted by the fill-up detecting portion 210 or when a cumulative count value exceeding a threshold has been inputted from the life detecting portion 220 as detection information. The display unit 240 is such as a liquid crystal screen of an operation panel provided on the printer 1, or a display screen of a terminal device (e.g., a personal computer) which uses the printer 1. Incidentally, from the viewpoint of realizing the reliable replacement of the collection box 8 before it is filled up, it suffices if a condition is set such that the life detecting portion 220 detects the replacement period at an earlier timing than the fill-up detecting portion 210.

<Printing Operation of Color Image>

The printing of a color image by the color printer 1 constructed as described above is generally effected as follows.

First, after the four photoconductor drums 21 have been uniformly charged by the charging rollers 22 in the image carrying unit 2, the laser beams Bm corresponding to image signals resolved into the respective colors of Y, M, C, and K are separately applied from the exposure unit 3 to the surfaces of the respective charged photoconductor drums 21. Electrostatic latent images of the respective colors corresponding to the input formation of the printer are thereby formed. Next, the electrostatic latent images on the photoconductor drums 21 are respectively developed by the developing devices 41 of the respective colors of the development unit 4, and are made visible as toner images of the respective colors of Y, M, C, and K.

Subsequently, the toner images of the respective colors formed on the photoconductor drums 21 are primarily transferred electrostatically onto the first intermediate transfer drums 25 and 26. Namely, yellow and magenta toner images formed on the photoconductor drums 21Y and 21M are consecutively transferred onto the first intermediate transfer drum 25 in the order of magenta and yellow in such a manner as to be superposed on top of each other. Meanwhile, cyan and black toner images formed on the photoconductor drums 21C and 21K are consecutively transferred onto the first intermediate transfer drum 26 in the order of black and cyan in such a manner as to be superposed on top of each other. As a result, a multiple toner image constituted by the magenta toner image and the yellow toner image is formed on the first intermediate transfer drum 25, while a multiple toner image constituted by the cyan toner image and the black toner image is formed on the first intermediate transfer drum 26.

Subsequently, the multiple toner images formed respectively on the first intermediate transfer drums 25 and 26 are secondarily transferred electrostatically onto the second intermediate transfer drum 27. Consequently, the toner images (M and Y from the lower layer side) on the first intermediate transfer drum 25 and the toner images (K and C from the lower layer side) on the first intermediate transfer drum 26 are respectively transferred in that order onto the second intermediate transfer drum 27, thereby forming a multiple toner image in which the toner images are superposed in the order of Y, M, C, and K from the lower layer side. Next, as the second intermediate transfer drum 27 rotates, this multiple toner image consisting of the four colors is transported toward a final transfer section where the multiple toner image is brought into pressure contact with the final transfer roller 51.

The recording paper P is fed from the paper feeding unit 6 toward the final transfer section at a predetermined timing in tune with the formation of such a toner image. Namely, only one sheet of the recording paper P accommodated in an accommodating tray 61 is fed out to the paper transporting path, and after the recording paper P is temporarily stopped by the registration roller 66, the recording paper P is fed into the final transfer section by that registration roller 66 at a predetermined timing. Consequently, the toner image of the four colors (Y, M, C, and K) on the second intermediate transfer drum 27 is collectively transferred electrostatically in a pressurized state onto the recording paper P which is fed into the final transfer section which is a pressure contact portion between the second intermediate transfer drum 27 and the final transfer roller 51.

Next, the recording paper P with the toner image of the four colors transferred thereon is fed to the fixing unit 7. After the recording paper P is subjected to fixation processing on heating and pressurization by passing through a fixing nip between the heating roller 71 and the pressure roller 72 in that fixing unit 7, the recording paper P is discharged to the paper discharging section 10B and 10C. It should be noted that in a case where double-sided printing is effected, the recording paper P after the fixation is temporarily stopped in a state of being held by the pair of discharge rollers 76 midway in the discharge to the discharging section 10B. Then, after the recording paper P is drawn into the inverting refeeding path 77 from a rear end in its feeding direction by the reverse rotation of the pair of discharge rollers 76, the recording paper P is fed again into the final transfer section at a predetermined timing by the pair of registration rollers 66.

A full-color image is formed on one sheet of recording paper P as the above-described series of image forming process is executed.

In addition, with this printer 1, since the trickle development system is adopted, at the time of the printing operation of a color image and the like, if the two-component developing agent is replenished to the developing devices 41 of its development unit 4, an excess portion of that two-component developing agent flows out from the developing-agent discharge port 49 of the developing-agent circulating/accommodating portion 48B (see FIGS. 7 and 11).

The two-component developing agent which flowed out from this developing-agent discharge port 49 of each developing device is collected and drops naturally through the collecting tubular portion 91 of the developing-agent transporting part 9, and is then transported to and collected in the collection box 8 through its transporting tubular portion 92 as the collecting developing agent 15. Meanwhile, the collecting developing agent 15 collected in the collection box 8 is gradually accumulated in the vicinity of the joint port 81 inside that box body 80. However, the collecting developing agent 15, while being stirred by the stirring/leveling member 84, is transported to the innermost side of the box body 81 and is thereby leveled.

<Replacement Operation of Image Carrying Unit and Collection Box>

With this printer 1, when a display prompting the replacement of the image carrying unit 2 is given on the display unit 240, and the replacement period of the image carrying unit 2 has arrived, the replacement of that image carrying unit 2 is carried out. In the replacement operation, after the operating surface portion 10A of the housing 10 is first opened (FIG. 5), the opening/closing cover 10C on the upper surface side is set in an open state (FIG. 6).

At this time, in particular, if the opening/closing cover 10C is opened, the guide plates 100A and 100B move in interlocked relation to opening operation about its pivot shaft 13A, as described above. Therefore, the development unit 4 moves the distance L (FIG. 15) in the horizontal direction q2 and is displaced to the position spaced apart from the image carrying unit 2 (from FIG. 13 to FIG. 14). As a result, the bearing portions 42*a* of the development rollers 42 in the development unit 4 are set in a state of being pulled out and spaced apart from the bearing holding grooves 20*e* of the image carrying unit 2. In addition, at the same time, the tip portion 92*a* of the transporting tubular portion 92 for transporting the collecting developing agent 15 is set in a state of being pulled out and spaced apart from the joint port 81 of the collection box 8 (FIG. 14). The joint port 81 is closed by the opening/closing cover 82 as the tip portion 92*a* of the transporting tubular portion 92 is pulled out. As a result, the image carrying unit 2 has its state of connection to the development unit 4 and the developing-agent transporting part 9 canceled, and is set in a free state.

Next, as for the image carrying unit 2 in such a state, as the handle 29 disposed on the upper surface portion 20C of its unit frame 20 is manually held and is pulled up in the vertical direction m1, the image carrying unit 2 is removed from the mounting portion of the housing 10. In addition, as a result of the removal of this image carrying unit 2, the collection box 8 mounted integrally therewith is also simultaneously removed from within the housing 10. Then, the removed old image carrying unit 2 and collection box 8 are appropriately disposed of (e.g., subjected to reuse through a required processing step). As for the removed old collection box 8, in particular, after it is removed from the flame 20 of the image carrying unit 2, the collecting developing agent 15 which has been collected in that box is removed and subjected to appropriate disposal.

On the other hand, instead of the removed old image carrying unit 2 and the like, a new image carrying unit 2 and collection box 8 in an integrated state are newly mounted in the housing 10. In the operation of mounting the new image carrying unit 2 and collection box 8, in a state in which the opening/closing cover 10C and the like are opened, the handle 29 disposed on the frame upper surface portion 20C of that image carrying unit is manually held and is pulled down in the vertical direction m2, thereby setting the new image carrying unit 2 and collection box 8 in the mounting portion of the housing 10. Subsequently, the opening/closing cover 10C is closed, and the operating surface portion 10A is then closed.

At this time, in particular, if the opening/closing cover 10C is closed, the guide plates 100A and 100B move in interlocked relation to that closing operation, as described above. Therefore, the development unit 4 moves in the horizontal direction q1 and is displaced to the position joined to the image carrying unit 2 (from FIG. 14 to FIG. 13). As a result, the bearing portions 42*a* of the development rollers 42 in the development unit 4 are set in a state of being fitted in and joined to the bearing holding grooves 20*e* of the image carrying unit 2. In addition, at the same time, the tip portion 92*a* of the transporting tubular portion 92 in the developing-agent transporting part 9 for transporting the collecting developing agent 15 is set in a state of being joined to the joint port 81 of the collection box 8 as it is inserted so as to push up the opening/closing cover (FIG. 13). As a result, the development unit 4 is set in a state of being integrated with the image carrying unit 2, and the collection box 8 is set in a usable state.

Thus, the collection box 8 can be replaced at the same time as the image carrying unit 2 which is a replacement part.

In addition, the collection box 8 is attached to a portion which is located on a rearward side, when viewed in the pulling-out direction (upward direction ml) at the time of the mounting or removing of the image carrying unit 2, and which is located on a forward side, when viewed in the mounting direction (downward direction m2). Therefore, the collection box 8 can be also moved integrally with the image carrying unit 2 in the moving space required for the mounting or removing of the image carrying unit 2. As a result, it is unnecessary to enlarge the width of such a moving space, and there is risk of the printer 1 becoming large-sized. Moreover, since this collection box 8 is attached to the portion which is the lower side of the image carrying unit 2, it is unnecessary to widen such a moving space. In particular, since the collection box 8 is installed at a position lower than any of the developing devices where the collecting developing agent to be collected occurs, the collecting developing agent can be easily transported to the collection box 8 and collected.

Further, in the replacement operation of the collection box 8, the developing-agent transporting part 9 is displaced between the position for joining the collection box 8 and the position spaced apart from the box 8 in interlocked relation to the opening or closing of the opening/closing cover 10C necessary for the mounting or removing of the image carrying unit 2. Therefore, the replacement operation of the collection box 8 can be easily performed. Moreover, since the operation of moving the transporting part 9 toward or away from the collection box 8 need not be performed manually, a user need not worry about his or her hand becoming smeared during the replacement operation, so that this arrangement is convenient.

The entire disclosure of Japanese Patent Application No. 2003-378987 filed on Nov. 7, 2003 including specification, claims, drawings and abstract is incorporated herein by reference in its entirely.

What is claimed is:

1. An image forming apparatus for forming an image with a developing agent, comprising:

a collecting-developing-agent occurring part in which a collecting developing agent to be collected in the developing agent occurs;

a collection container for accommodating the collecting developing agent;

a transporting part to connect the collection container and the collecting-developing-agent occurring part and for collecting and transporting the collecting-developing-agent occurring in the collecting-developing-agent occurring part; and a replacement part removably mounted in an apparatus body, wherein the collection container is mounted to be integrated with the replacement part.

2. The image forming apparatus according to claim 1, wherein the collection container is disposed at a portion which is located on a forward side or a rearward side in a moving direction of the replacement part at a time of mounting or removing the replacement part.

3. The image forming apparatus according to claim 1 or 2, wherein the collection container is mounted at a portion of a lower side of the replacement part.

4. The image forming apparatus according to claim 1, wherein in a case where the image forming apparatus comprises a cover to be opened or closed at a time of mounting or removing the replacement part to which the collection container is mounted, the transporting part is mounted to be displaced between a position where the transporting part joins to the collection container and a position where the transporting part is apart from the collection container, with opening/closing operation of a cover.

5. The image forming apparatus according to claim 1, further comprising:

a first detection portion that detects a replacement period of the collection container, and a second detection portion that detects a replacement period of the replacement part on which the collection container is mounted; and a portion that issues information prompting replacement of the replacement part when either one of the first detection portion and the second detection portion detects the replacement period.

6. The image forming apparatus according to claim 1, wherein the collecting-developing-agent occurring part is a developing device where a collecting developing agent occurs.

7. The image forming apparatus according to claim 1, wherein the replacement part is a process cartridge having at least an image carrier for holding an image with a developing agent.

8. The image forming apparatus according to claim 1, wherein the collecting-developing-agent occurring part is a cleaning device for removing and collecting the collecting developing agent.

9. An image forming apparatus, comprising:

developing devices for effecting development with developing agents of a plurality of colors;

an image carrying unit in which image carriers carrying toner images of the plurality of colors are integrally mounted;

a collection box for accommodating a collecting developing agent to be collected; and a developing-agent transporting part to connect each of the developing devices and the collection box and for collecting and transporting the collecting developing agent.

10. The image forming apparatus according to claim 9, wherein each of the developing devices includes:

a development roller rotating in close proximity to a photoconductor drum of the image carrying unit;

a paddle rotating so as to supply the developing agent to the development roller; and an auger rotating so as to transport the developing agent to the paddle.

11. The image forming apparatus according to claim 9, wherein the image carrying unit involves:

photoconductor drums on which toner images of the plurality of colors are respectively formed;

first transfer drains for transferring and carrying the toner images on the photoconductor drums; and a second transfer dram for transferring and carrying the toner images on the first transfer drams.

12. The image forming apparatus according to claim 9, the collection box includes:

a joint port joined to the developing-agent transporting part;

a opening/closing cover urged in a direction of closing the joint port; and a stirring member for stirring the collecting developing agent accommodated in the collection box.

13. The image forming apparatus according to claim 9, the developing-agent transporting part involves:

a collecting tubular portion for collecting the collecting developing agent flowing out each of the developing devices; and a transporting tubular portion for transporting the collecting developing agent collected by the collecting tubular portion to the collection box.

14. The image forming apparatus according to claim 9, the collection tubular portion is set in a state of being connected to rear portions of the developing devices, and the transporting tubular portion is provided so that the transporting tubular portion is passed in a lower portion of the lowest developing device and a tip portion of the transporting tubular portion projects to a side opposing the collection box.

15. The image forming apparatus according to claim 9, wherein the developing devices are provided in a unit frame having slide grooves in each of side portion of the unit frame, and the unit frame moves by a pair of guide plates disposed on side surfaces of the unit frame, engaging with the slide grooves and adapted to move diagonally by means of opening and closing a cover of the image forming apparatus between a position where the developing unit is apart from the image carrying unit and a position where the developing unit joins to the image carrying unit.

16. A method of replacing an image carrying unit and a collection box in an image forming apparatus, comprising the steps of:

opening an opening/closing cover on an upper surface of the image forming apparatus; and pulling up the image carrying unit as well as the collection box simultaneously from the image forming apparatus, wherein the image carrying unit is separated from developing devices and the collection box is separated from a developing-agent transporting part.

17. The method according to claim 16, mounting a new image carrying unit and a new collection box in the image forming apparatus; and closing the opening/closing cover so that the new image carrying unit joins to the developing devices and the new collection box joins to the developing-agent transporting part.

* * * * *